US012612852B2

(12) United States Patent
Richards et al.

(10) Patent No.: US 12,612,852 B2
(45) Date of Patent: Apr. 28, 2026

(54) DEVICES, SYSTEMS, AND METHODS FOR DOWNHOLE SURVEYING

(71) Applicant: Schlumberger Technology Corporation, Sugar Land, TX (US)

(72) Inventors: Edward Richards, Stonehouse (GB); Ross Lowdon, Bucharest (RO); Shady Altayeb Mussa, Sugar Land, TX (US); Makito Katayama, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/116,398

(22) PCT Filed: Oct. 4, 2023

(86) PCT No.: PCT/US2023/034449
§ 371 (c)(1),
(2) Date: Mar. 28, 2025

(87) PCT Pub. No.: WO2024/076622
PCT Pub. Date: Apr. 11, 2024

(65) Prior Publication Data

US 2026/0002434 A1 Jan. 1, 2026

Related U.S. Application Data

(60) Provisional application No. 63/378,282, filed on Oct. 4, 2022.

(51) Int. Cl.
*E21B 44/00* (2006.01)
*E21B 7/06* (2006.01)
*E21B 47/0228* (2012.01)

(52) U.S. Cl.
CPC ..... *E21B 44/005* (2013.01); *E21B 7/067* (2013.01); *E21B 47/0228* (2020.05)

(58) Field of Classification Search
CPC ..... E21B 47/0228; E21B 44/005; E21B 7/067
See application file for complete search history.

(56) References Cited

U.S. PATENT DOCUMENTS

2005/0022402 A1 2/2005 Ash
2005/0269082 A1 12/2005 Baron et al.
(Continued)

FOREIGN PATENT DOCUMENTS

WO 2015061051 A1 4/2015
WO WO-2021016309 A1 * 1/2021 ..... E21B 47/0228

OTHER PUBLICATIONS

International Search Report and Written Opinion of International Patent Application No. PCT/US2023/034449 dated on Jan. 30, 2024, 12 pages.

*Primary Examiner* — Giovanna Wright
(74) *Attorney, Agent, or Firm* — Kyle R. Miiller

(57) ABSTRACT

A drilling system may include a steering tool configured to engage a wellbore wall to direct an orientation of a toolface, the steering tool being rotatable about a rotational axis. A drilling system may include an azimuth sensor package, the azimuth sensor package including at least one of a multi-axis gyroscopic azimuth sensor rotatable about the rotational axis of the steering tool, a multi-axis magnetic azimuth sensor rotatable about the rotational axis of the steering tool, or an accelerometer azimuth sensor rotatable about the rotational axis of the steering tool.

8 Claims, 14 Drawing Sheets

(56) References Cited

U.S. PATENT DOCUMENTS

| | | | | |
|---|---|---|---|---|
| 2013/0151158 | A1* | 6/2013 | Brooks | E21B 47/022 702/92 |
| 2015/0331138 | A1* | 11/2015 | Estes | G01V 13/00 324/346 |
| 2016/0177704 | A1 | 6/2016 | Steenwyk | |
| 2019/0169974 | A1 | 6/2019 | Uribe et al. | |
| 2021/0040839 | A1 | 2/2021 | Tackmann et al. | |
| 2022/0251938 | A1 | 8/2022 | Whitmore et al. | |

* cited by examiner

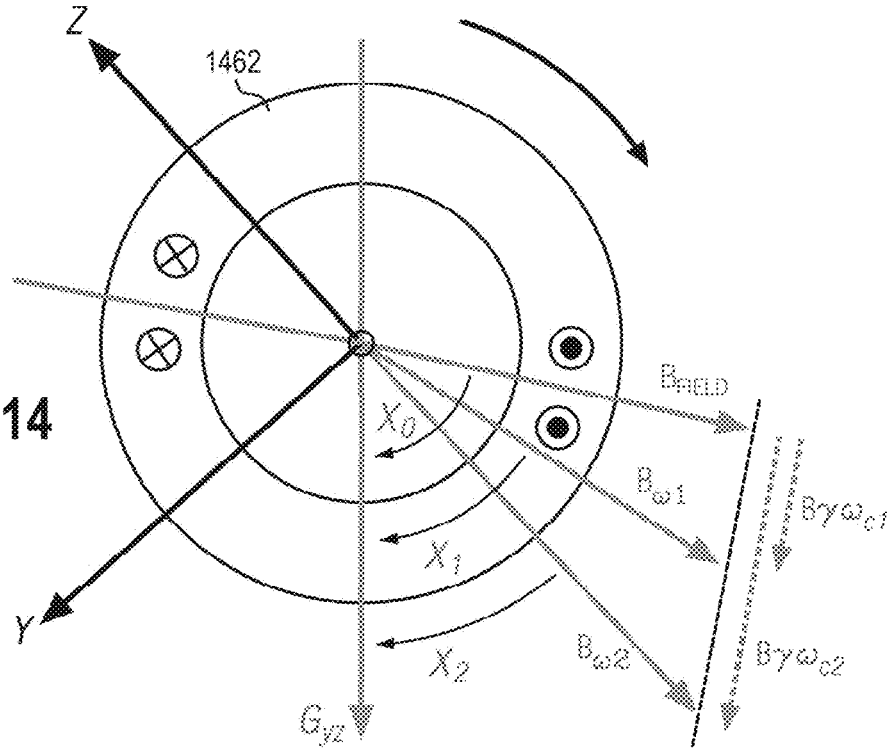

FIG. 14

1562 Rotate Drill Bit to Drill

1564 Slowly Rotate Roll Stabilized Sensor Housing

1560

1566 Make Accelerometer and Magnetometer Measurements in Slowly Rotating Sensor Housing 1568 Process Accelerometer Measurements to Compute Wellbore Inclination 1570 Compute Eddy Current Compensation Term(s)

1572 Compute Magnetometer Bias

1574 Compute Wellbore Azimuth

1578 Adjust the Direction of Drilling in Response to the Wellbore Inclination and Wellbore Azimuth

FIG. 15A

DEVICES, SYSTEMS, AND METHODS FOR DOWNHOLE SURVEYING

CROSS-REFERENCE TO RELATED APPLICATIONS

This application is the National Stage Entry of International Application No. PCT/US2023/034449, filed on Oct. 4, 2023, which claims priority to and the benefit of U.S. Provisional Patent Application No. 63/378,282, filed on Oct. 4, 2022, entitled DEVICES, SYSTEMS, AND METHODS FOR DOWNHOLE SURVEYING, which is hereby incorporated by reference in its entirety.

BACKGROUND

Modern drilling operations may change the trajectory of a wellbore through the process of directional drilling. While drilling, it may become necessary to determine the location and/or drilling trajectory. Survey instruments located on a downhole tool may be used to measure azimuth, inclination, and other survey information. Survey instruments may include a multi-axis gyroscopic sensor, such as a MEMS (Micro-ElectroMechanical Systems) gyroscope, a multi-axis magnetic sensor, or an accelerometer sensor. Using survey data, the downhole tool may determine direction information, including azimuth and/or inclination of the downhole tool.

In conventional drilling and measurement while drilling (MWD) operations, wellbore inclination and wellbore azimuth are determined at a discrete number of longitudinal points along the axis of the wellbore. These discrete measurements may be assembled into a survey of the well and used to calculate a three-dimensional well path (e.g., using the minimum curvature or other curvature assumptions). Wellbore inclination is commonly derived (computed) from tri-axial accelerometer measurements of the earth's gravitational field. Wellbore azimuth (also commonly referred to as magnetic azimuth) is commonly derived from a combination of tri-axial accelerometer and tri-axial magnetometer measurements of the earth's gravitational and magnetic fields.

Static surveying measurements are commonly made after drilling has temporarily stopped (e.g., when a new length of drill pipe is added to the drill string) and the drill bit is lifted off bottom. Such static measurements are often made at measured depth intervals ranging from about 30 to about 90 feet. While these static surveying measurements may, in certain operations, be sufficient to obtain a well path of suitable accuracy, such static surveying measurements are time consuming as they require drilling to temporarily stop and the drill string to be lifted off the bottom of the wellbore.

While the use of dynamic surveying measurements is known, such measurements tend to be prone to error, for example, from magnetic interference such as eddy current induced magnetic fields and uncompensated magnetometer bias.

SUMMARY

In some aspects, the techniques described herein relate to a rotary steerable system for drilling a subterranean wellbore. The rotary steerable system includes a roll-stabilized housing deployed in a drill collar. The drill collar is configured to rotate with a drill string, the roll-stabilized housing is configured to rotate independent of the drill collar while drilling. An azimuth sensor package includes a multi-axis gyroscopic azimuth sensor rotatable about a rotational axis of the roll-stabilized housing. The azimuth sensor package includes at least one of: a rotation rate sensor configured to measure a rotation rate of the drill collar; a triaxial accelerometer set; and a triaxial magnetometer set deployed in the roll-stabilized housing.

In some aspects, the techniques described herein relate to a method for drilling a subterranean wellbore. The method includes rotating a bottom hole assembly (BHA) in the subterranean wellbore to drill. The BHA includes a roll-stabilized housing deployed in a drill collar and is configured to rotate with respect to the drill collar. The BHA further includes a triaxial accelerometer set, a triaxial magnetometer set, and a gyroscopic azimuth sensor deployed in the roll-stabilized housing. The steerable drilling system collects azimuth measurements using the gyroscopic azimuth sensor. Using the triaxial accelerometer set and the triaxial magnetometer set, the steerable drilling system makes corresponding triaxial accelerometer measurements and triaxial magnetometer measurements while the BHA rotates. The steerable drilling system measures a rotation rate of the drill collar while the BHA rotates. The steerable drilling system generates a toolface of the BHA using the azimuth measurements. The steerable drilling system generates an azimuth of the BHA using the toolface of the BHA, the triaxial magnetometer measurements, and the rotation rate.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 14 depicts a cross section of an example drill collar including schematic magnetic field vectors, according to at least one embodiment of the present disclosure;

FIGS. 15A and 15B (collectively FIG. 15) depict flow charts of example methods for drilling a subterranean wellbore, according to at least one embodiment of the present disclosure.

DETAILED DESCRIPTION

This disclosure generally relates to devices, systems, and methods for downhole surveying. A downhole drilling system may include a bottomhole assembly ("BHA"). The BHA may include a steering tool and an azimuth sensor package. The azimuth sensor package may determine a toolface azimuth. The azimuth sensor package may include one or more sensors. For example, the azimuth sensor package may include one or more of a multi-axis gyroscopic azimuth sensor, a multi-axis magnetic azimuth sensor, or an accelerometer azimuth sensor. The sensors of the azimuth sensor package may be rotatable about a rotational axis of the steering tool. Including the azimuth sensor package on the BHA may allow the downhole drilling system to prepare more accurate and/or more representative azimuth measurements of the toolface. In this manner, a drilling operator may adjust the trajectory of the BHA based on the azimuth measurements to more closely adhere to a target trajectory and/or be more responsive to sensed downhole conditions.

Figure 1:
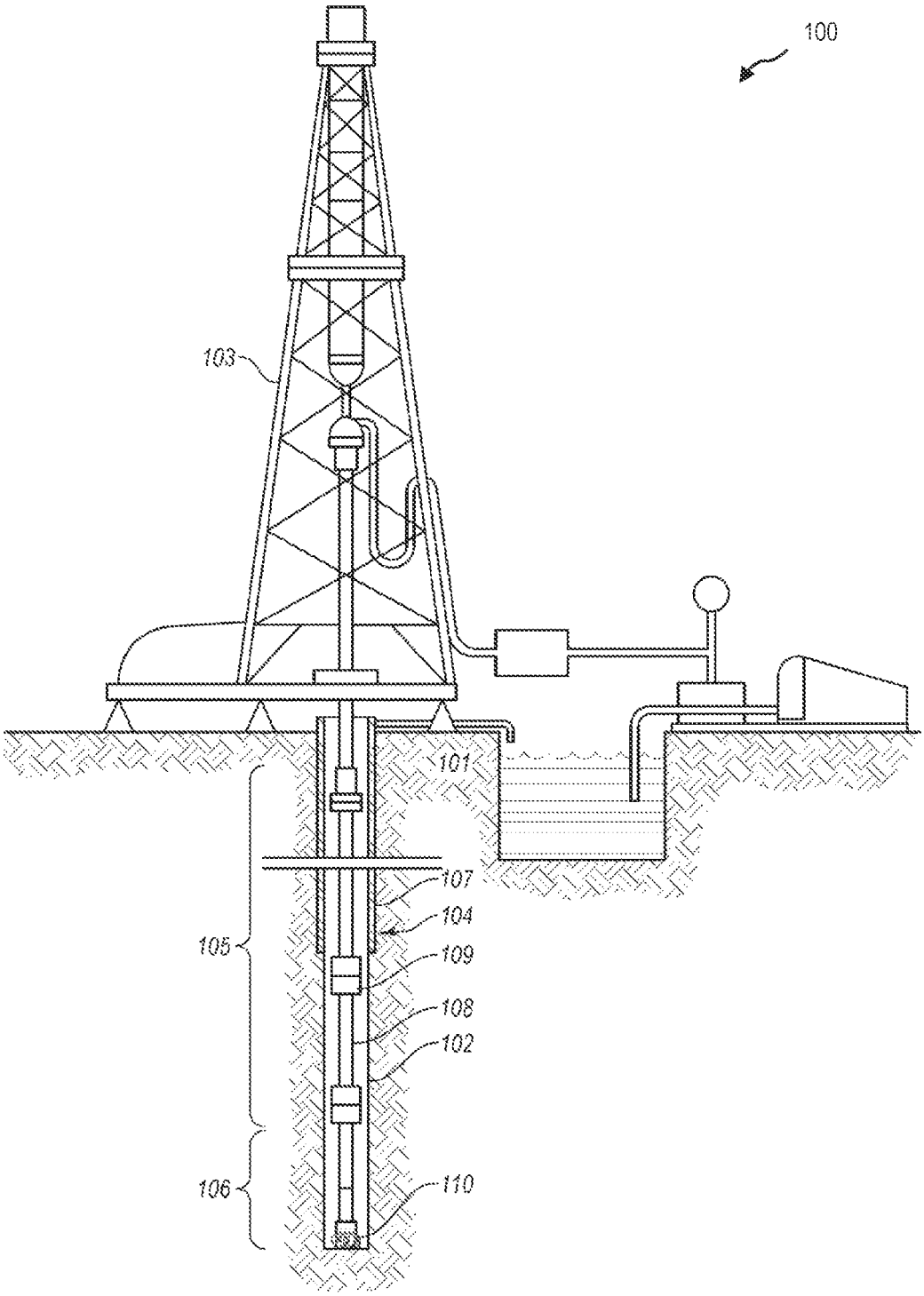
FIG. 1 is a schematic view of a drilling system for drilling an earth formation to form a wellbore, according to at least one embodiment of the present disclosure.

FIG. 1 shows one example of a downhole drilling system 100 for drilling an earth formation 101 to form a wellbore 102. The downhole drilling system 100 includes a drill rig 103 used to turn a drilling tool assembly 104 which extends downward into the wellbore 102. The drilling tool assembly 104 may include a drill string 105, a BHA 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a steering tool. The steering tool may engage the wellbore wall to direct an orientation of the toolface of the bit. The steering tool may engage the wellbore wall in any manner. For example, the steering tool may engage the wellbore wall at a particular orientation while rotating, such as with a rotary steering tool ("RSS"). In some examples, the steering tool may engage the wellbore wall by sliding along the wellbore wall, such as during slide steering. In some embodiments, the steering tool may engage the wellbore wall in any manner.

In accordance with embodiments of the present disclosure, the BHA 106 may include an azimuth sensor package including one or more azimuth sensors. The azimuth sensor package may be used to determine the azimuth and/or inclination of the downhole tools. The azimuth may be the orientation direction of the downhole tool with respect to north. In some embodiments, the azimuth may be the orientation direction of the downhole tool with respect to magnetic north or true north. In some embodiments, the azimuth may be the orientation direction of the downhole tool with respect to true north. True north may be the location on the earth that corresponds to where the rotational axis of the earth extends through its outer surface. In some embodiments, true north may be aligned with the rotational axis of the earth. Basing the azimuth off true north may result in an azimuth that is not affected by the variations in the earth's magnetic field.

In accordance with at least one embodiment of the present disclosure, the azimuth sensor package may be located on or at the BHA 106. Including the azimuth sensor package on the BHA 106 may allow the azimuth sensor package to collect azimuth measurements closer to the bit 110. The closer azimuth measurements are taken to the bit 110, the more representative that the azimuth measurements will be of conditions at the bit 110. Thus, by placing the azimuth sensor package on the BHA 106, the azimuth sensor package may collect azimuth measurements that are representative of conditions at the bit 110. In some embodiments, the sensor distance of the azimuth sensor package to the bit 110 may be in a range having an upper value, a lower value, or upper and lower values including any of immediately behind the bit, 1 m, 2 m, 3 m, 4 m, 5 m, 6 m, 7 m, 8 m, 9 m, 10 m, 15 m, 20 m, or any value therebetween. For example, the sensor distance may be greater than immediately behind the bit 110. In another example, the sensor distance may be less than 20 m. In yet other examples, the sensor distance may be any value in a range between immediately behind the bit and 20 m. In some embodiments, it may be critical that the sensor distance is less than 10 m to generate azimuth measurements representative of conditions at the bit 110.

During drilling operations, the BHA 106 may be subjected to vibrations, oscillations, bumps, impacts, and other motions. These motions may cause instruments on the BHA 106 to similarly experience vibrations, oscillations, bumps, impacts, and other motions. This may cause instruments on the BHA 106 to become uncalibrated.

The azimuth sensor package may include one or more multi-axis magnetic azimuth sensors (as used herein, magnetic azimuth sensors). Magnetic azimuth sensors may be robust and collect consistent directional measurements in the harsh vibrational conditions of the BHA 106. But magnetic azimuth sensors collect azimuthal measurements based on the earth's magnetic field. Magnetic azimuth sensors may experience interference when collecting measurements from magnetic materials in the BHA 106. For example, drill pipes, subs, mud motors, electrical systems, other sensors, any other magnetically interfering elements, and combinations thereof may interfere with the magnetic survey measurements. This may reduce the accuracy and/or precision of the magnetic azimuthal survey.

In some situations, magnetic azimuth sensors may collect magnetic azimuth measurements to determine the orientation of the toolface with respect to magnetic north. The magnetic azimuth measurements may be based on the earth's magnetic field. Based on the earth's magnetic field, the magnetic azimuth measurements may result in inaccurate and/or imprecise determined toolface orientations based on the magnetic azimuth sensor in a zone of exclusion. The zone of exclusion may be a zone in which magnetic azimuth measurements are conventionally unreliable. The zone of exclusion may result from electromagnetic noise, such as electromagnetic noise from inside the BHA or outside the BHA.

In some embodiments, the zone of exclusion may be a result of azimuths that are difficult to measure based on the orientation of the magnetic field. For example, the zone of exclusion may include azimuths that are parallel or approximately parallel to magnetic north. In some embodiments, the zone of exclusion may be, with respect to magnetic north, in a range having an upper value, a lower value, or upper and lower values including any of 0.5°, 10, 2°, 30, 4°, 5°, 10°, or any value therebetween. For example, the zone of exclusion may be greater than 0.5°. In another example, the zone of exclusion may be less than 10°. In yet other examples, the zone of exclusion may be any value in a range between 0.5° and 10°.

Furthermore, many downhole tools are formed from magnetic material, which may introduce uncertainty into measurements using magnetic sensors. Basing the azimuth off true north may reduce uncertainties caused by magnetic interference with magnetic compasses and other magnetic sensors.

The azimuth sensor package may include a multi-axis gyroscopic azimuth sensor (as used herein, a gyroscopic azimuth sensor). The gyroscopic azimuth sensor may include one or more gyroscopes oriented around (and/or rotated around) different axes. The measurements from the gyroscopes may be used to determine the orientation of the toolface with respect to true north, or with respect to the earth's rotational axis. The gyroscopic north measurements may be accurate and precise.

In some situations, the motions of the BHA 106 may cause one or more of the gyroscopes to become uncalibrated. For example, the motions of the BHA 106 may introduce bias into one or more of the gyroscopes of a gyroscope azimuth sensor.

The azimuth sensor package may include an accelerometer azimuth sensor. The accelerometer azimuth sensor may include one or more accelerometers. The accelerometers may measure accelerometer azimuth measurements. The accelerometer azimuth measurements may include measurements based on changes in the forces applied to the BHA 106 (e.g., changes in the acceleration on the BHA 106). The accelerometer azimuth measurements may be used to determine changes in the position of the toolface. In some situations, the accelerometer azimuth measurements may be used to determine the inclination of the toolface. In some situations, the accelerometer azimuth measurements may be used to help correct bias in the gyroscopic azimuth sensor.

In accordance with at least one embodiment of the present disclosure, the BHA 106 may include an azimuth sensor package that includes one or more of the magnetic azimuth sensor, the gyroscopic azimuth sensor, or the accelerometer azimuth sensor. For example, the BHA 106 may include an azimuth sensor package that only includes the magnetic azimuth sensor. In some examples, the BHA 106 may include an azimuth sensor package that only includes the gyroscopic azimuth sensor. In some examples, the BHA 106 may include an azimuth sensor package that only includes the accelerometer azimuth sensor.

In some embodiments, the BHA 106 may include an azimuth sensor package that includes the magnetic azimuth sensor and the gyroscopic azimuth sensor. In some embodiments, the BHA 106 may include an azimuth sensor package that includes the magnetic azimuth sensor and the accelerometer azimuth sensor. In some embodiments, the BHA 106 may include an azimuth sensor package that includes the gyroscopic azimuth sensor and the accelerometer azimuth sensor. In some embodiments, the BHA 106 may include an azimuth sensor package that includes each of the magnetic azimuth sensor, the gyroscopic azimuth sensor, and the accelerometer azimuth sensor.

Including multiple azimuth sensors in the azimuth sensor package on the BHA 106 may help to generate azimuth measurements that are more accurate and/or more representative of actual conditions at the toolface or the bit 110. For example, multiple azimuth sensors on the BHA 106 may allow comparison between the azimuth measurements. In this manner, the generated azimuth of the toolface may be based on multiple measurements, thereby improving its accuracy and/or representation of the conditions at the toolface.

In some embodiments, the multiple azimuth sensors on the BHA 106 may be used to provide correction and/or calibration for each other. For example, the magnetic sensor measurements may be used to correct bias introduced into the gyroscopes of the gyroscopic azimuth sensor, such as bias introduced during vibrations of the BHA 106 during operation. In this manner, the magnetic azimuth sensor may be used to maintain the operating condition of the gyroscopic azimuth sensor. This may allow the gyroscopic azimuth sensor to collect gyroscopic azimuth measurements to generate an azimuth for the toolface relative to true north.

In some embodiments, the gyroscopic azimuth sensor may be used to calibrate the magnetic azimuth sensor. As discussed herein, the magnetic azimuth sensor may experience magnetic interference based on magnetic material and/or electromagnetic fields on the BHA 106 and/or other portions of the downhole drilling system. Furthermore, the magnetic north may be offset from true north by 100 or more, based on the location on the earth and/or variations in the earth's magnetic field. Azimuths determined using magnetic azimuth measurements may have a correction applied based on the offset and/or the magnetic interference. The correction may be used to correct the magnetic azimuth to true north. In some situations, the correction may be applied using tables based on known magnetic interference and/or a known position of the toolface.

In accordance with at least one embodiment of the present disclosure, the gyroscopic azimuth measurements may be used to determine the correction from the magnetic azimuth to the true north azimuth. For example, the magnetic azimuth sensor may collect magnetic azimuth measurements and the gyroscopic azimuth sensor may collect gyroscopic azimuth measurements. The gyroscopic azimuth measurements may be used to determine a true north azimuth and the magnetic azimuth measurements may be used to determine a magnetic azimuth. The difference between the true north azimuth and the magnetic azimuth may be the correction. This correction may then be applied to subsequent magnetic azimuths determined using magnetic azimuth measurements. In this manner, the magnetic azimuths generated by the magnetic azimuth sensor may be more accurate and/or representative of the true north azimuth of the toolface.

The azimuth sensor package may be used with any type of downhole drilling system 100. For example, the azimuth sensor package may be used with the top-drive downhole drilling system 100 shown. In some examples, the azimuth sensor package may be used with other drilling systems, such as a wireline drilling system or any other drilling system.

In some embodiments, the azimuth sensor package may be located on an RSS. For example, the azimuth sensor package may be located on a roll-stabilized platform on the RSS. The roll-stabilized platform may include an inner housing that is independently rotatable from an outer housing, with the outer housing being rotatable by the top-drive. In a roll-stabilized platform, the inner housing may be independently rotatable such that the inner housing may have any rotational rate with respect to an absolute frame of reference, such as the force of gravity. In some embodiments, the inner housing may not rotate with respect to the absolute frame of reference while the outer housing is rotating with respect to the absolute frame of reference. In some embodiments the inner housing may rotate with any rotational rate with respect to the outer housing and/or the absolute frame of reference.

In some embodiments, the azimuth sensor package may be located on the inner housing of the roll-stabilized platform. Put another way, the gyroscopic azimuth sensor, the magnetic azimuth sensor, the accelerometer azimuth sensor, and combinations thereof, may be located on the inner housing of the roll-stabilized platform. In some embodiments, the azimuth sensor package may collect measurements on the roll-stabilized platform while the inner housing is rotating independently from the outer housing. For example, the gyroscopic sensor tool may collect the gyroscopic azimuth measurements while the inner housing is rotating independently from the outer housing. In some examples, the gyroscopic sensor tool may collect the gyroscopic azimuth measurements while the inner housing is not rotating while the outer housing is rotating. In some examples, the gyroscopic sensor tool may collect the gyroscopic azimuth measurements while the inner housing is rotating at a different rotational rate than the outer housing.

In some embodiments, the magnetic azimuth sensor may collect the magnetic azimuth measurements while the inner housing is rotating independently from the outer housing. In some examples, the magnetic sensor tool may collect the magnetic azimuth measurements while the inner housing is not rotating while the outer housing is rotating. In some examples, the magnetic sensor tool may collect the magnetic azimuth measurements while the inner housing is rotating at a different rotational rate than the outer housing.

In some embodiments, the accelerometer azimuth sensor may collect the accelerometer azimuth measurements while the inner housing is rotating independently from the outer housing. In some examples, the accelerometer sensor tool may collect the accelerometer azimuth measurements while the inner housing is not rotating while the outer housing is rotating. In some examples, the accelerometer sensor tool may collect the accelerometer azimuth measurements while the inner housing is rotating at a different rotational rate than the outer housing.

In some embodiments, the azimuth sensor package may collect two or more of the gyroscopic azimuth measurements, the magnetic azimuth measurements, or the accelerometer azimuth measurements while the inner housing is rotating at a different rotational rate than the outer housing. For example, the azimuth sensor package may collect the gyroscopic azimuth measurements and the magnetic azimuth measurements while the inner housing is rotating at a different rotational rate than the outer housing. In some examples, the azimuth sensor package may collect the gyroscopic azimuth measurements and the accelerometer azimuth measurements while the inner housing is rotating at a different rotational rate than the outer housing. In some examples, the azimuth sensor package may collect the magnetic azimuth measurements and the accelerometer azimuth measurements while the inner housing is rotating at a different rotational rate than the outer housing. In some examples, the azimuth sensor package may collect each of the gyroscopic azimuth measurements, the magnetic azimuth measurements, and the accelerometer azimuth measurements while the inner housing is rotating at a different rotational rate than the outer housing.

In accordance with at least one embodiment of the present disclosure, collecting azimuth measurements while the inner housing is rotating at a different rotational rate than the housing may help to improve the accuracy and/or precision of the generated azimuths. For example, this may allow the azimuth sensor package to collect azimuth measurements during drilling activities. In some examples, this may allow the azimuth sensor package to collect azimuth measurements while the inner housing is slowly rotating. Collecting measurements while the inner housing is rotating may help the sensors of the azimuth sensor package to account for bias and/or misalignment in their measurements, thereby improving the azimuths generated using the azimuth measurements.

In some embodiments, the azimuth sensor package may be rotationally fixed to the BHA 106 and/or the bit 110. For example, the steering system used to steer the bit 110 may be a bent-housing steering system, a slide steering system, or other fixed-housing steering system. The azimuth sensor package may be rotationally fixed to the fixed-housing steering system. In some embodiments, the azimuth sensor package may collect azimuth measurements while the fixed-housing steering system is rotating during drilling activities. In some embodiments, the azimuth sensor package may collect azimuth measurements while the fixed-housing steering system is not rotating. For example, the azimuth sensor package may collect azimuth measurements during stand or drill-pipe changes.

In some embodiments, the downhole drilling system 100 may include an inertial position manager that may determine an inertial position of the toolface and/or the bit 110. The inertial position manager may use the azimuth measurements to generate an inertial position of the toolface. For example, the combination gyroscopic azimuth measurements, magnetic azimuth measurements, and accelerometer azimuth measurements may be used to generate an inertial position of the toolface. The inertial position may be a dead-reckoning position, or a position that is determined based on the orientation of the toolface combined with changes in position of the toolface. The inertial position may allow the downhole drilling system 100 to know the 3-dimensional position of the toolface with greater accuracy. This may help the downhole drilling system 100 to direct the toolface to maintain a trajectory, avoid certain geological features (such as formations or offset wellbores), and engage other geological features.

In general, the downhole drilling system 100 may include other drilling components and accessories, such as special valves (e.g., kelly cocks, blowout preventers, and safety valves). Additional components included in the downhole drilling system 100 may be considered a part of the drilling tool assembly 104, the drill string 105, or a part of the BHA 106 depending on their locations in the downhole drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
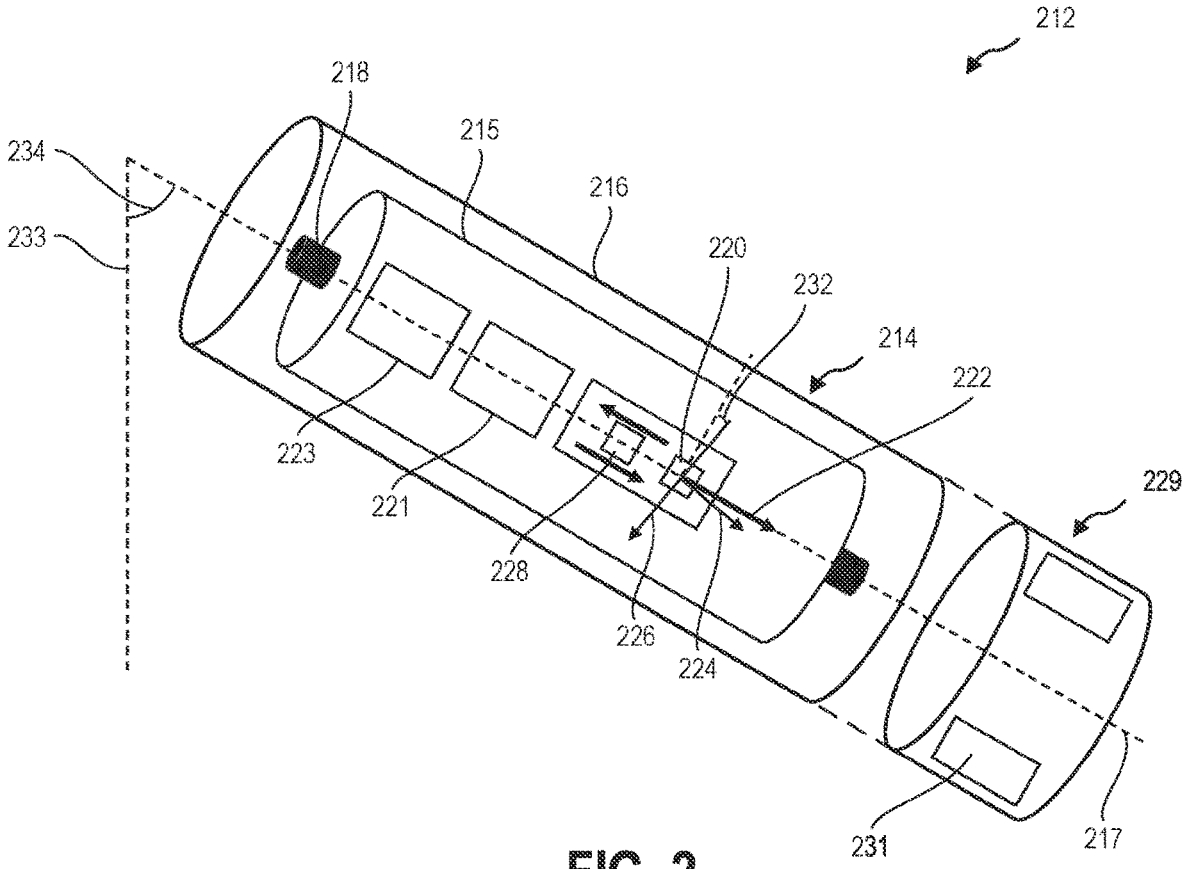
FIG. 2 is a schematic, perspective view of a downhole tool including an azimuthal survey package, according to at least one embodiment of the present disclosure.

FIG. 2 is a representation of a steerable drilling system 212 including an azimuthal survey package 214, according to at least one embodiment of the present disclosure. The steerable drilling system 212 includes an outer housing 216. The outer housing 216 may be rotationally connected to the bit (e.g., the bit 110 of FIG. 1) and/or the drill string (e.g., the drill string 105 of FIG. 1). Put another way, the outer housing 216 may rotate with the same rotational rate as the bit and/or the drill string. In some situations, the outer housing 216 may rotate about a tool rotational axis 217 with a high rotational rate, such as 50 RPM, 100 RPM, 200 RPM, 500 RPM, 1,000 RPM, 2,000 RPM, or higher. In some embodiments, the azimuthal survey package 214 is coupled to the bit or the drill string by being part of, or coupled to, a directional drilling tool 229, such as a rotary steerable tool having movable pads 231 that push against the borehole as part of a push-the-bit drilling system. In other embodiments, the directional drilling tool 229 may include a motor with a bent housing, a point-the-bit configuration, other directional drilling tools, or combinations of the foregoing.

The azimuthal survey package 214 may be located in an interior of the outer housing 216. In some embodiments, the azimuthal survey package 214 may be located on an independently rotatable member 215 (e.g., the inner housing). In some embodiments, the independently rotatable member 215 may be coaxial with the outer housing 216 and may rotate about the tool rotational axis 217. The independently rotatable member 215 (and therefore the azimuthal survey package 214) may be rotationally stabilized with respect to the outer housing 216. Put another way, the azimuthal survey package 214 may be independently rotatable to the outer housing 216. The independently rotatable member 215 may be connected to the outer housing 216 with one or more stabilizers 218, which may include one or more bearings used to change the rotational rate relative to the outer housing 216.

In some embodiments, the independently rotatable member 215 may have a counter-torque applied so that it rotates at a different rate than the outer housing 216. In some embodiments, the azimuthal survey package 214 may rotate at a lower rate than the outer housing 216. In some embodiments, the azimuthal survey package 214 may be maintained stationary with respect to an external reference, such as the force of gravity.

The azimuthal survey package 214 may include one or more survey instruments. For example, the azimuthal survey package 214 shown includes a multi-axis gyroscopic azimuth sensor 220, a multi-axis magnetic azimuth sensor 221, and a multi-axis accelerometer azimuth sensor 223. As may be seen, each of the sensors of the azimuthal survey package 214 may be located on the independently rotatable member 215. The multi-axis gyroscopic azimuth sensor 220, the multi-axis magnetic azimuth sensor 221, and the multi-axis accelerometer azimuth sensor 223 may collect measurements along multiple axes, or with respect to multiple axes. In the embodiment shown, the x-axis 222 may be parallel to the tool rotational axis 217, the z-axis 226 may be perpendicular to the x-axis 222 in the direction of the gravitational force, and the y-axis 224 may be perpendicular to both the x-axis 222 and the z-axis 226.

The multi-axis gyroscopic azimuth sensor 220 may include one or more gyroscopes, such as a multi-axis gyroscope. The multi-axis gyroscope may collect gyroscopic measurements along one or more axes. In some embodiments, the multi-axis gyroscope may collect x-axis 222 gyroscopic measurements, y-axis 224 gyroscopic measurements, and z-axis 226 gyroscopic measurements. In some embodiments, the multi-axis accelerometer azimuth sensor 223 may collect x-axis 222 accelerometer measurements, y-axis 224 accelerometer measurements, and z-axis 226 accelerometer measurements. In some embodiments, the multi-axis magnetic azimuth sensor 221 may collect magnetic measurements along one or more axes. For example, the multi-axis magnetic azimuth sensor 221 may collect x-axis 222 magnetic measurements, y-axis 224 magnetic measurements, and z-axis 226 magnetic measurements. In this manner, the gyroscopic azimuth measurements, the accelerometer azimuth measurements, and the magnetic azimuth measurements may be taken close to each other, thereby improving the correlation between the two measurements.

In some embodiments, the azimuthal survey package 214 may further include an indexing gyroscope 228. The indexing gyroscope 228 may be oriented along the tool rotational axis 217. The indexing gyroscope 228 may collect measurements along an indexing axis in a first direction and a second direction. Flipping the indexing gyroscope 228 along the indexing axis may help to compensate and/or remove any bias in gyroscopic measurements caused by misalignment of the indexing gyroscope 228. In some embodiments, any of the gyroscopes on the azimuthal survey package 214 may be indexed to compensate and/or remove any bias in the gyroscopes. For example, a multi-axis gyroscopic azimuth sensor 220 may include one, two, three, four, five, six, or more gyroscopes, each of which may be flipped to compensate and/or remove any bias that may accrue.

The steerable drilling system 212 has a toolface angle 232, which may be the angle between the z-axis 226 and a perpendicular axis 233 perpendicular to the tool rotational axis 217. As discussed further herein, the toolface angle 232 may be a reference angle for the determination of the tool azimuth of the steerable drilling system 212. The steerable drilling system 212 may further have an inclination 234, which may be defined by the angle between a perpendicular axis 233 and the tool rotational axis 217. The inclination 234 may help to determine the tool azimuth of the steerable drilling system 212. The inclination 234 may be determined using the accelerometer azimuth measurements. In some embodiments, the inclination 234 may be determined using the accelerometer azimuth measurements, the gyroscopic azimuth measurements, and the magnetic azimuth measurements.

As discussed herein, the azimuthal survey package 214 may be used to generate azimuth measurements. The azimuth measurements may be used to generate the toolface angle 232 and/or the inclination 234 of the steerable drilling system 212. In some embodiments, collecting azimuth measurements on the independently rotatable member 215 may help to improve the generated toolface angles 232.

In some embodiments, the azimuthal survey package 214 may include a downhole processor. The azimuthal survey package 214 may be used to receive the azimuth measurements from the multi-axis gyroscopic azimuth sensor 220, the multi-axis magnetic azimuth sensor 221, and the multi-axis accelerometer azimuth sensor 223. In some embodiments, using the azimuth measurements, the azimuthal survey package 214 may generate a toolface angle 232 downhole.

In some embodiments, the BHA may receive information from the azimuthal survey package 214. In some embodiments, the BHA transmit the azimuth measurements uphole to the surface. In some embodiments, the BHA may transmit the raw azimuth measurements. In some embodiments, the BHA may transmit the toolface angle 232 uphole to the surface. This may help to reduce the amount of information transmitted uphole, thereby saving limited transmission bandwidth.

In some embodiments, the BHA may utilize the toolface angle 232 to prepare a correction of the trajectory of the steerable drilling system 212. For example, the BHA may compare the toolface angle 232 to a target toolface angle. If the toolface angle 232 is different than the target toolface angle, the BHA may prepare a correction of the trajectory of the steerable drilling system 212. For example, the BHA may send a signal to the steering tool to adjust the trajectory, including the azimuth and/or the inclination, of the steerable drilling system 212. In this manner, the azimuthal survey package 214 may create a feedback loop with the steerable drilling system 212. The BHA may instruct the steering tool to adjust the azimuth of the steerable drilling system 212. After a period of time or distance drilled, the azimuthal survey package 214 may collect another set of azimuth measurements and generate another toolface angle 232. The new toolface angle 232 may be compared to the target azimuth, and the BHA may prepare a correction to the steering tool, as appropriate. In this manner, the steerable drilling system 212 may be autonomous or semi-autonomous. This may help the steerable drilling system 212 to stay on a target trajectory and/or decrease the amount of information transmitted uphole to the surface.

In some embodiments, as discussed herein, the azimuthal survey package 214 may generate azimuth measurements that may be used to prepare an inertial position of the steerable drilling system 212. For example, the azimuthal survey package 214 may use the toolface angle 232 and the accelerometer measurements to determine how far the steerable drilling system 212 has traveled. In some embodiments, the BHA may transmit the inertial positioning information to the surface, and the inertial position may be determined or generated at the surface. In some embodiments, the azimuthal survey package 214 may prepare or generate the inertial position downhole at the azimuthal survey package 214. The BHA may use the inertial position in the autonomous or semi-autonomous drilling. For example, the BHA may use the inertial position to determine the location of the steerable drilling system 212 with respect to downhole features, such as geological features, offset wellbores, and so forth. Using the inertial position of the steerable drilling system 212 with respect to downhole features, the BHA may prepare a correction to the steering tool to avoid or head toward the downhole features.

Figure 3:
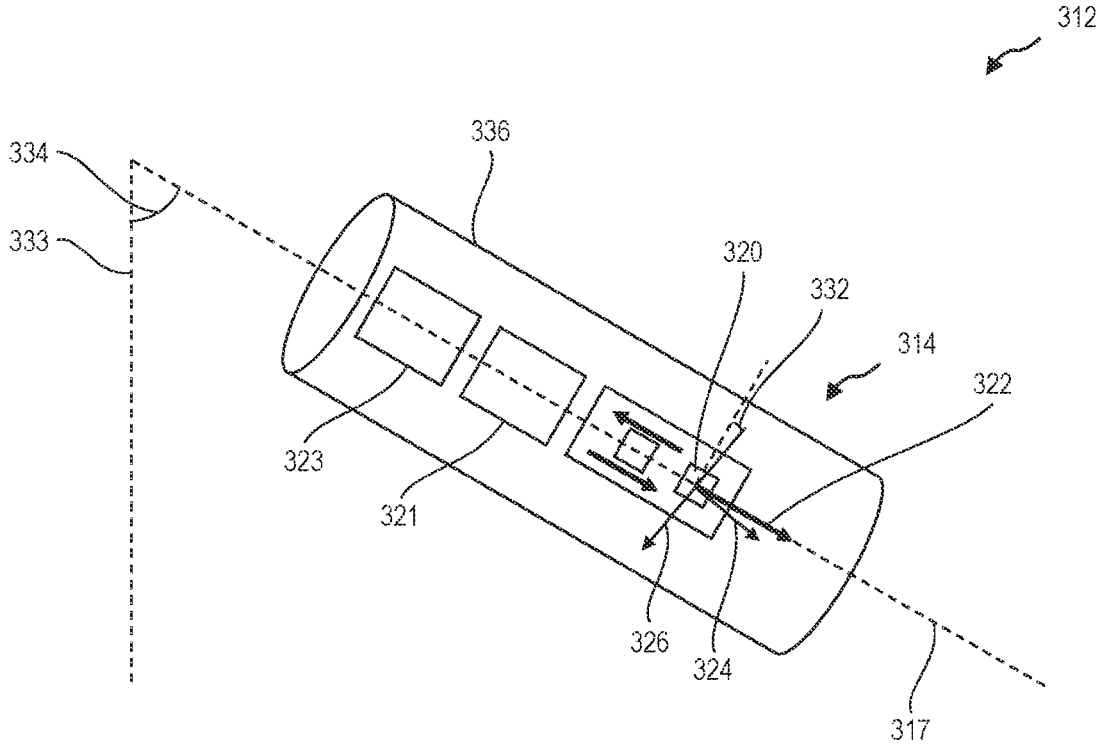
FIG. 3 is a schematic, perspective view of a downhole tool including an azimuthal survey package, according to at least one embodiment of the present disclosure.

FIG. 3 is a representation of a steerable drilling system 312 including an azimuthal survey package 314, according to at least one embodiment of the present disclosure. The steerable drilling system 312 includes a housing 336. The housing 336 may be rotationally connected to the bit (e.g., the bit 110 of FIG. 1) and/or the drill string (e.g., the drill string 105 of FIG. 1). Put another way, the housing 336 may rotate with the same rotational rate as the bit and/or the drill string. In some situations, the housing 336 may rotate about a tool rotational axis 317 with a high rotational rate, such as 50 RPM, 100 RPM, 200 RPM, 500 RPM, 1,000 RPM, 2,000 RPM, or higher.

The azimuthal survey package 314 may be rotationally fixed to the housing 336 and may include one or more survey instruments. For example, the azimuthal survey package 314 shown includes a multi-axis gyroscopic azimuth sensor 320, a multi-axis magnetic azimuth sensor 321, and a multi-axis accelerometer azimuth sensor 323. As may be seen, each of the sensors of the azimuthal survey package 314 may be located on the housing 336. The multi-axis gyroscopic azimuth sensor 320, the multi-axis magnetic azimuth sensor 321, and the multi-axis accelerometer azimuth sensor 323 may collect measurements along multiple axes, or with respect to multiple axes. In the embodiment shown, the x-axis may 322 be parallel to the tool rotational axis 317, the z-axis 326 may be perpendicular to the x-axis 322 in the direction of the gravitational force, and the y-axis 324 may be perpendicular to both the x-axis 322 and the z-axis 326.

As discussed herein, the multi-axis gyroscopic azimuth sensor 320 may collect gyroscope azimuth measurements along the x-axis 322, the z-axis 326, and the y-axis 324. The multi-axis magnetic azimuth sensor 321 may collect magnetic azimuth measurements along the x-axis 322, the z-axis 326, and the y-axis 324. The multi-axis accelerometer azimuth sensor 323 may collect accelerometer azimuth measurements along the x-axis 322, the z-axis 326, and the y-axis 324.

The azimuth measurements may be used to determine a toolface trajectory, including a toolface azimuth, a toolface angle 332 and/or an inclination 334 measured with respect to a perpendicular axis 333. By collecting the azimuth measurements along the multiple axes on the housing 336, the azimuthal survey package 314 may generate a toolface angle 332 that is more accurate and/or more representative of the actual toolface angle 332 of the steerable drilling system 212.

As discussed herein, the azimuth measurements, the toolface angle 332, the inclination 334, and combinations thereof, may be transmitted uphole to the surface. At the surface, a drilling operator may use the azimuth measurements and/or the toolface angle 332 to prepare adjustments and/or corrections to a steering tool. In some embodiments, the azimuthal survey package 314 may prepare or generate the toolface angle 332 downhole. Using the toolface angle 332, the BHA may prepare corrections to the steering to adjust the trajectory of the steerable drilling system 312 during autonomous or semi-autonomous drilling operations.

As discussed herein, the azimuth measurements, the toolface angle 332, the inclination 334, and combinations thereof, may be used to generate an inertial position of the steerable drilling system 312. In some embodiments, the BHA may use the inertial position of the steerable drilling system 312 alone or in combination with the toolface angle 332 to prepare corrections to the trajectory of the steerable drilling system 312 during autonomous or semi-autonomous drilling operations. This may help to improve the steering of the steerable drilling system 312.

Figure 4:
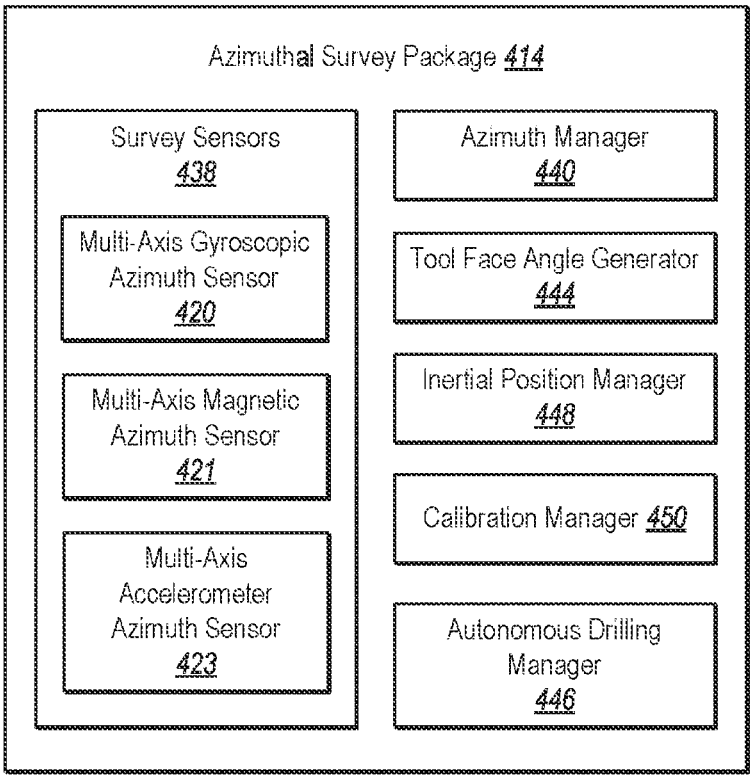
FIG. 4 is a representation of an azimuthal survey package, according to at least one embodiment of the present disclosure.

FIG. 4 is a representation of an azimuthal survey package 414, according to at least one embodiment of the present disclosure. Each of the components of the azimuthal survey package 414 can include software, hardware, or both. For example, the components can include one or more instructions stored on a computer-readable storage medium and executable by processors of one or more computing devices. In some embodiments, the computing devices may be located downhole, such as on the BHA (e.g., the BHA 106 of FIG. 1). In some embodiments, the computing devices may be located at the surface, such as a client device or server device. When executed by the one or more processors, the computer-executable instructions of the azimuthal survey package 414 can cause the computing device(s) to perform the methods described herein. Alternatively, the components can include hardware, such as a special-purpose processing device to perform a certain function or group of functions. Alternatively, the components of the azimuthal survey package 414 can include a combination of computer-executable instructions and hardware.

Furthermore, the components of the azimuthal survey package 414 may, for example, be implemented downhole as one or more operating systems, as one or more standalone applications, as one or more modules of an application, as one or more plug-ins, as one or more library functions or functions that may be called by other applications. In some examples, the components of the azimuthal survey package 414 may be implemented at a surface location, including as a cloud-computing model.

The azimuthal survey package 414 may include survey sensors 438. The survey sensors 438 may include a multi-axis gyroscopic azimuth sensor 420, a multi-axis magnetic azimuth sensor 421, and a multi-axis accelerometer azimuth sensor 423.

An azimuth manager 440 may collect azimuth measurements from the survey sensors 438. For example, the azimuth manager 440 may collect gyroscope azimuth measurements from the multi-axis gyroscopic azimuth sensor 420, magnetic azimuth measurements from the multi-axis magnetic azimuth sensor 421, and accelerometer azimuth measurements from the multi-axis accelerometer azimuth sensor 423.

The azimuth manager 440 may collect the azimuth measurements periodically and/or episodically. For example, the azimuth manager 440 may collect the azimuth measurements on a periodic time basis, such as every second, every minute, every five minutes, every 30 minutes, every hour, and so forth. In some examples, the azimuth manager 440 may collect the azimuth measurements on a periodic distance basis. For example, the azimuth manager 440 may collect the azimuth measurements every 1 m, every 5 m, every 10 m, every 15 m, every 20 m, every 25 m, every 30 m, every 35 m, every 40 m, every 45 m, every 50 m, and so forth. In some examples, the azimuth manager 440 may collect the azimuth measurements when the azimuthal survey package 414 receives instructions. For example, the azimuth manager 440 may collect the azimuth measurements when the azimuthal survey package 414 receives instructions from a surface location, the BHA, an MWD tool, a LWD tool, any other location, and combinations thereof.

The azimuthal survey package 414 includes a toolface angle generator 444. Using the azimuth measurements from the survey sensors 438, and received by the azimuth manager 440, the toolface angle generator 444 may generate an azimuth and/or a toolface angle of the downhole tool. As discussed herein, the toolface angle generator 444 may be located at a surface location. The toolface angle generator 444 may receive the azimuth measurements from the azimuth manager 440 at the surface and generate the azimuth of the toolface at the surface. In some embodiments, the toolface angle generator 444 may be located downhole. For example, the toolface angle generator 444 may be located on the azimuthal survey package 414, at the BHA, at an MWD, at an LWD, at any other downhole location, and combinations thereof.

The azimuthal survey package 414 may include an autonomous drilling manager 446. The autonomous drilling manager 446 may utilize the toolface azimuth generated by the toolface angle generator 444 to prepare adjustments to the trajectory of the downhole tool. For example, the autonomous drilling manager 446 may prepare corrections to a steering tool to adjust the trajectory of the downhole tool.

In some embodiments, the autonomous drilling manager 446 may receive no input from a drilling operator. The autonomous drilling manager 446 may include a model that, when applied to the toolface azimuth, may determine whether the measured toolface azimuth is different than a target azimuth based on a target trajectory of the wellbore. In some embodiments, the autonomous drilling manager 446 may compare the measured toolface azimuth to the target trajectory in real-time. Real-time trajectory comparison may allow the autonomous drilling manager 446 to be more responsive to changing drilling conditions. In this manner, the autonomous drilling manager 446 may help the wellbore to maintain the position of the target wellbore trajectory.

In some embodiments, the autonomous drilling manager 446 may receive input from a drilling operator. For example, the autonomous drilling manager 446 may transmit a proposed change to the trajectory of the downhole tool. Upon receipt of the operator approval, the autonomous drilling manager 446 may implement the trajectory. In this manner, the autonomous drilling manager 446 may be a semi-autonomous drilling manager.

The azimuthal survey package 414 may further include an inertial position manager 448. The inertial position manager 448 may prepare an inertial position of the downhole tool using the azimuth measurements from the azimuth manager 440. As discussed herein, the inertial position manager 448 may use the toolface azimuth and inertial information to determine the inertial position of the downhole tool. In some embodiments, the autonomous drilling manager 446 may use the inertial position of the downhole tool to make drilling decisions. For example, the autonomous drilling manager 446 may prepare trajectory corrections based on the inertial position and how close or far away from downhole features the downhole tool is.

In accordance with at least one embodiment of the present disclosure, the azimuthal survey package 414 may include a calibration manager 450. The calibration manager 450 may use the azimuth measurements received from the azimuth manager 440 to calibrate the survey sensors 438. For example, the calibration manager 450 may use the gyroscopic azimuth measurements to calibrate the multi-axis magnetic azimuth sensor 421. The toolface azimuth generated by the toolface angle generator 444 using the gyroscopic azimuth measurements may be used to prepare the correction to the magnetic azimuth generated using the magnetic azimuth measurements. In this manner, the calibration manager 450 may help to calibrate multi-axis magnetic azimuth sensor 421, thereby improving the accuracy and/or representativeness of the magnetic azimuth generated by the toolface angle generator 444 using the magnetic azimuth measurements.

In some examples, the calibration manager 450 may use the magnetic azimuth measurements to calibrate and/or remove bias from the multi-axis gyroscopic azimuth sensor 420. For example, the calibration manager 450 may use the magnetic azimuth generated by the toolface angle generator 444 to correct for bias drift of the multi-axis gyroscopic azimuth sensor 420. This may help to improve the accuracy and/or representativeness of the gyroscopic azimuth generated by the toolface angle generator 444 using the gyroscopic azimuth measurements. In some embodiments, the calibration manager 450 may use the azimuth measurements to regularly calibrate the survey sensors 438. This may help to improve the accuracy and/or representativeness of the toolface azimuth generated by the toolface angle generator 444.

Figure 5:
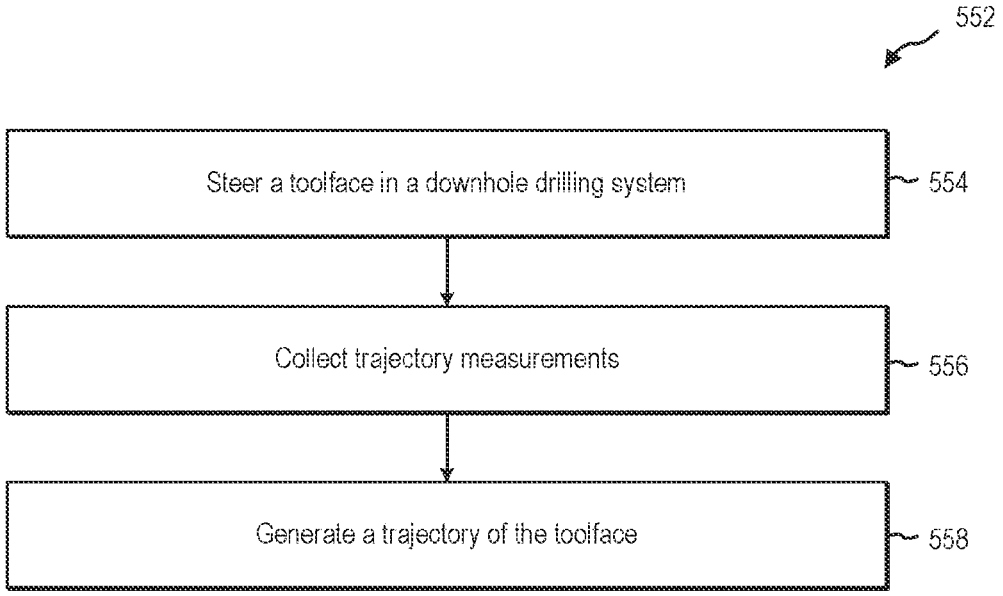
FIG. 5 is a flowchart of a method for performing a downhole survey, according to at least one embodiment of the present disclosure.
Figure 6:
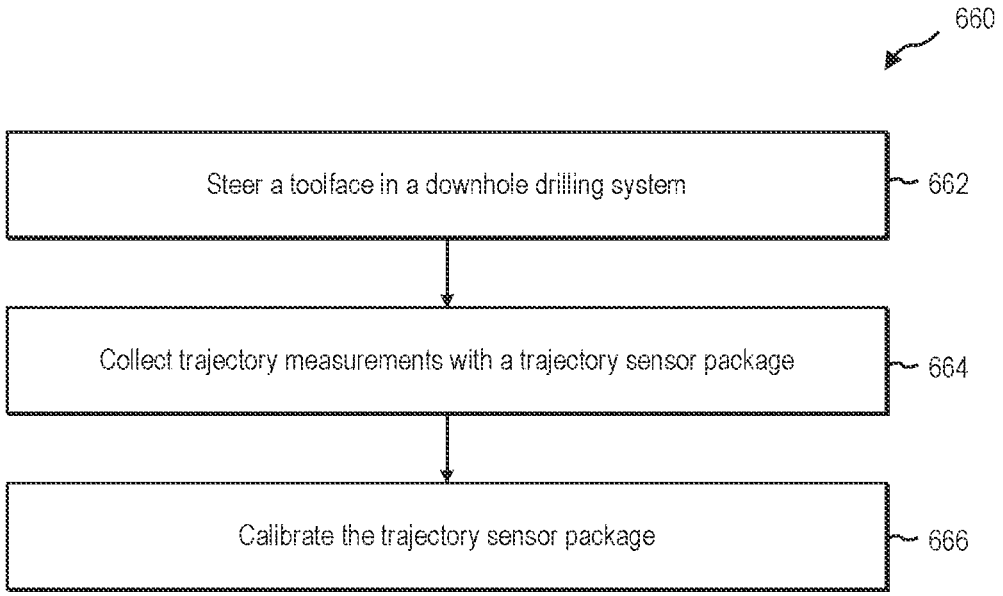
FIG. 6 is a flowchart of a method for performing a downhole survey, according to at least one embodiment of the present disclosure.

FIGS. 5-6, the corresponding text, and the examples provide a number of different methods, systems, devices, and computer-readable media of the downhole survey system. In addition to the foregoing, one or more embodiments can also be described in terms of flowcharts comprising acts for accomplishing a particular result, as shown in FIGS. 5-6. FIGS. 5-6 may be performed with more or fewer acts. Further, the acts may be performed in differing orders. Additionally, the acts described herein may be repeated or performed in parallel with one another or parallel with different instances of the same or similar acts.

As mentioned, FIG. 5 is a flowchart of method 552 of a series of acts performed on a bottomhole assembly, in accordance with at least one embodiment of the present disclosure. While FIG. 5 illustrates acts according to one embodiment, alternative embodiments may omit, add to, reorder, and/or modify any of the acts shown in FIG. 5. The acts of FIG. 5 can be performed as part of a method. Alternatively, a computer-readable medium can comprise instructions that, when executed by one or more processors, cause a computing device to perform the acts of FIG. 5. In some embodiments, a system can perform the acts of FIG. 5.

The method 552 may include steering a toolface in a downhole drilling system at 554. A steering tool may engage a wellbore wall. The steering tool may be any type of steering tool. For example, the steering tool may be an RSS, a bent-housing tool, a slide steering tool, or any other steering tool. In some examples, the steering tool may be a push-the-bit steering tool, a point-the-bit steering tool, a hybrid push/point-the-bit steering tool, and combinations thereof. In some embodiments, the downhole drilling system may include a bit drilling tool that engages and degrades the formation. In some embodiments, the downhole drilling system may include a plasma drilling tool and/or a jetting drilling tool. The downhole survey system may collect azimuth measurements at the steering tool at 556. The azimuth measurements may be collected with an azimuth sensor package. The azimuth measurements may include at least one of gyroscopic azimuth measurements, magnetic azimuth measurements, or accelerometer measurements. Using the azimuth measurements, the downhole survey system may generate an azimuth of the toolface at 558. In some embodiments, the azimuth of the toolface may be generated in the zone of exclusion, or approximately parallel to magnetic north.

In some embodiments, collecting the azimuth measurements may include collecting any combination of two azimuth measurements, including the gyroscopic azimuth measurements and the magnetic azimuth measurements, the gyroscopic azimuth measurements and the accelerometer azimuth measurements, and the magnetic azimuth measurements and the accelerometer azimuth measurements. In some embodiments, collecting the azimuth measurements may include collecting each of the azimuth measurements.

In some embodiments, the method may include adjusting steering of the toolface based on the azimuth of the steering tool. For example, as discussed herein, the downhole survey system may include an autonomous drilling manager. The autonomous drilling manager may make drilling decisions based on the toolface azimuth and/or inertial position of the downhole tool.

In some embodiments, the method may include collecting the azimuth measurements while rotating the steering tool. In some embodiments, the method may include independently rotating the azimuthal survey package while rotating the steering tool. In some embodiments, the azimuthal survey package may be maintained in a roll-stabilized position while collecting the azimuth measurements.

In some embodiments, the downhole survey system may include generating an inertial position of the toolface using the azimuth measurements. The inertial position may be used during autonomous drilling to correct the trajectory of the downhole tool based on the location of downhole features.

As mentioned, FIG. 6 is a flowchart of method 660 of a series of acts performed on a bottomhole assembly, in accordance with at least one embodiment of the present disclosure. While FIG. 6 illustrates acts according to one embodiment, alternative embodiments may omit, add to, reorder, and/or modify any of the acts shown in FIG. 6. The acts of FIG. 6 can be performed as part of a method. Alternatively, a computer-readable medium can comprise instructions that, when executed by one or more processors, cause a computing device to perform the acts of FIG. 6. In some embodiments, a system can perform the acts of FIG. 6.

The method 660 may include steering a toolface in a downhole drilling system at 662. A steering tool may engage a wellbore wall. The steering tool may be any type of steering tool. For example, the steering tool may be an RSS, a bent-housing tool, a slide steering tool, or any other steering tool. The downhole survey system may collect azimuth measurements at the steering tool at 664. The azimuth measurements may be collected with an azimuth sensor package. The azimuth measurements may include at least one of gyroscopic azimuth measurements, magnetic azimuth measurements, or accelerometer measurements.

Using the azimuth measurements, a downhole survey system may calibrate the trajectory sensor package at 666. For example, the downhole survey system may use the gyroscopic azimuth generated using the gyroscopic azimuth measurements to prepare a correction for the magnetic azimuth generated using the magnetic azimuth measurements. In some examples, the downhole survey system may use the magnetic azimuth generated using the magnetic azimuth measurements to correct for bias introduced to the gyroscopic azimuth sensor.

According to some aspects of the present disclosure, a solid state or mechanical gyroscope package is placed within a directional drilling tool such as an RSS. Where the drilling tool is an RSS, the tool may be a strap down (rotate with bit/housing) or roll stabilized tool (geostationary with rotation independent of bit/housing) for the purpose of performing an azimuthal survey. A solid state or mechanical gyroscope may be placed within an MWD or LWD tool for the purpose of performing an azimuthal survey. A solid state or mechanical gyroscope may be placed within auxiliary drilling equipment in a BHA or drill string such that it can communicate with (to and/or from) at least one of a directional drilling tool (e.g., RSS or MWD) for the purpose of performing an azimuthal survey. In some embodiments, a solid state gyroscope can operate with three or fewer axes. In some embodiments, a solid state gyroscope can be flipped around any of its axes to provide bias correction. In at least some embodiments, a gyroscope package contains 1, 2, 3, or more accelerometers. In at least some embodiments, a gyroscope package is connected to a battery or other power supply with sufficient power to operate the gyroscope package. In at least some embodiments, a gyroscope package is connected to one or more processors capable of making azimuthal orientation calculations. Optionally, data (e.g., survey data) could also be used within a fusion model in conjunction with flux gate or other type of magnetometers and/or accelerometers (e.g., MCM) to improve survey accuracy. In some embodiments, data generated (e.g., survey data) can be communicated to a surface location and/or between tools in a BHA by mud pulse, direct connection, electromagnetic methods (e.g., EM pulse, shorthop), or wired drill pipe. In some embodiments, data collected (e.g., survey data) is used as part of a closed loop automation process for controlling drilling trajectories. In some embodiments, a gyroscopic survey is used for bias compensation of one or more magnetometers in a dynamic drilling survey (e.g., while drilling and/or rotating).

Methods for drilling a subterranean wellbore are disclosed. Example methods include rotating a BHA in the subterranean wellbore to drill, in which the BHA includes a drill collar, a drill bit, a roll-stabilized housing deployed in the drill collar and configured to rotate with respect to the drill collar, and a triaxial accelerometer set and a triaxial magnetometer set deployed in the roll-stabilized housing. Triaxial accelerometer and triaxial magnetometer measurements and a drill collar rotation rate measurement are made while the BHA rotates. A wellbore inclination and a gravity tool face of the roll-stabilized housing are computed from the triaxial accelerometer measurements. The computed inclination, the computed gravity toolface, the triaxial magnetometer measurements, and the measured rotation rate of the drill collar are processed to compute an azimuth of the subterranean wellbore, wherein influences of eddy currents and magnetometer biases are accounted for in the computed azimuth. In certain example embodiments, the computed gravity toolface, the triaxial magnetometer measurements, and the measured rotation rate of the drill collar are processed with a Kalman Filter. In other example embodiments, the measured rotation rate of the drill collar is processed to compute an eddy current compensation term. In still other example embodiments, the triaxial magnetometer measurements are processed using multi-station analysis to compute the magnetometer bias.

Example embodiments disclosed herein may provide various technical advantages and improvements over the prior art. For example, an improved method and system for drilling a subterranean wellbore includes making dynamic survey measurements, such as wellbore inclination and wellbore azimuth measurements, in substantially real time while drilling a well (e.g., several measurements per minute or several measurements per foot of measured depth of the wellbore). Moreover, the disclosed embodiments may advantageously compensate (account for) eddy currents and/or eddy current influence in the drill collar and/or roll-stabilized housing and magnetometer bias in the magnetometer measurements and may therefore provide improved accuracy (particularly dynamic azimuth measurements having improved accuracy). The disclosed embodiments may further compute updated eddy current compensation terms and magnetometer bias while drilling and may therefore advantageously account for changes in eddy current influence and magnetometer bias effects during the drilling operation.

It will be appreciated that the disclosed embodiments may further provide a much higher density of survey measurements along the wellbore profile than are available via conventional static surveying methods, thereby enabling a more accurate wellbore path to be determined. Improving the timeliness and density of wellbore surveys may further advantageously improve the speed and effectiveness of wellbore steering activities, such as wellbore path correction and anti-collision decision making.

Figure 7:
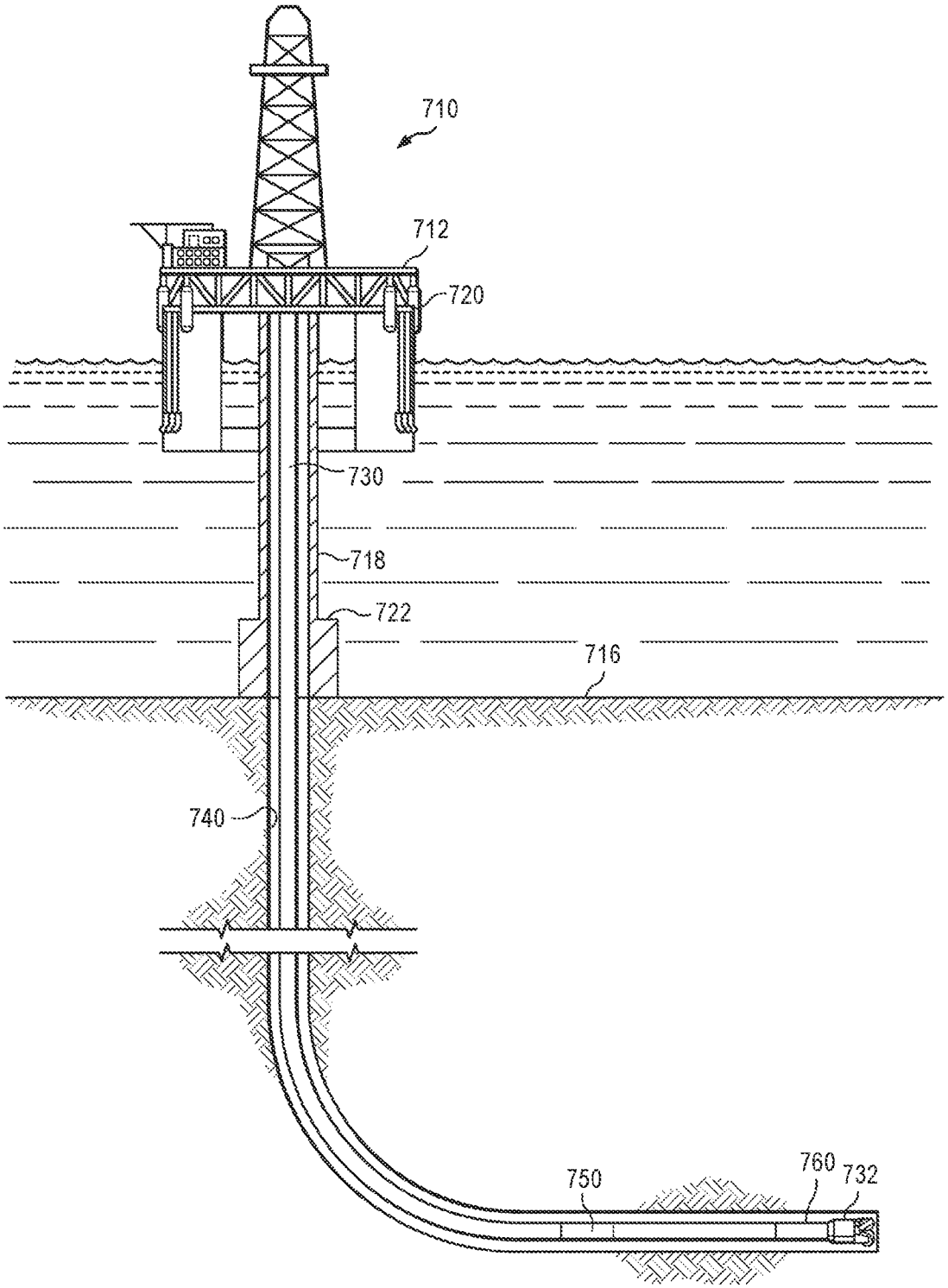
FIG. 7 depicts a drilling rig on which disclosed embodiments may be utilized, according to at least one embodiment of the present disclosure.

FIG. 7 depicts a drilling rig 710 suitable for implementing various method embodiments disclosed herein. A semisubmersible drilling platform 712 is positioned over an oil or gas formation disposed below the sea floor 716. A subsea conduit 718 extends from deck 720 of platform 712 to a wellhead installation 722. The platform may include a derrick and a hoisting apparatus for raising and lowering a drill string 730, which, as shown, extends into wellbore 740 and includes a drill bit 732 and a rotary steerable tool 760. Drill string 730 may further include a downhole drilling motor, a downhole telemetry system, and one or more measurement while drilling (MWD) or logging while drilling (LWD) tools 750 including various sensors for sensing downhole characteristics of the wellbore and the surrounding formation. The disclosed embodiments are not limited in these regards.

It will be understood by those of ordinary skill in the art that the deployment illustrated on FIG. 7 is merely an example. It will be further understood that disclosed embodiments are not limited to use with a semisubmersible platform 712 as illustrated on FIG. 7. The disclosed embodiments are equally well suited for use with any kind of subterranean drilling operation, either offshore or onshore.

Figure 8:
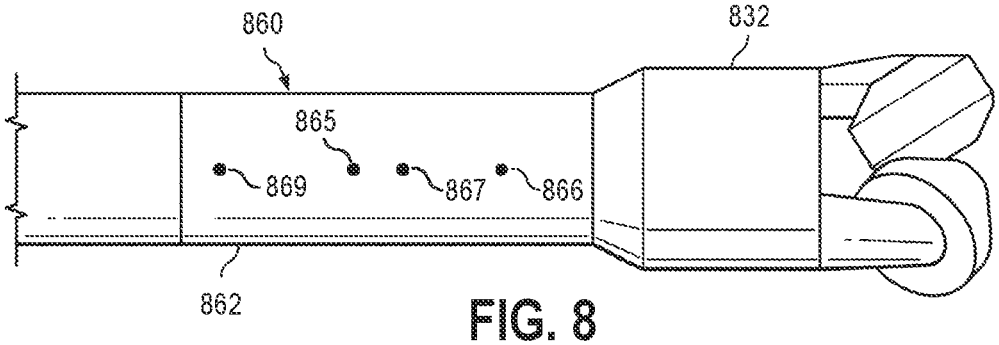
FIG. 8 depicts a lower BHA portion of the drill string shown on FIG. 7.

FIG. 8 depicts the lower BHA portion of drill string 730 (FIG. 7) including drill bit 832 and rotary steerable tool 860. The rotary steerable tool may include substantially any suitable rotary steering tool including a roll-stabilized controller (or control unit) deployed in a roll-stabilized housing or an otherwise substantially non-rotating or geostationary housing. By roll-stabilized it is meant that the sensor housing is substantially non-rotating with respect to the wellbore (or may at times rotate slowly in comparison to the drill string).

While FIG. 8 depicts a rotary steerable tool 860, it will be understood that the disclosed embodiments are not limited to the use of a rotary steerable tool. Moreover, while navigation sensors 865 and 867 (e.g., accelerometers and magnetometers) may be deployed and the corresponding sensor measurements processed in a rotary steerable tool (e.g., as depicted on FIG. 8), they may also be located in a roll-stabilized housing located substantially anywhere in the drill string. As discussed above with respect to FIG. 2, the rotary steerable tool 860 may further include one or more gyroscopes or gyroscopic sensors 866. For example, with reference again to FIG. 7, drill string 730 may include a measurement while drilling tool 750 including corresponding sensors deployed in a roll-stabilized housing. As is known to those of ordinary skill in the art, such MWD tools 750 may further include a mud pulse telemetry transmitter or other telemetry system, an alternator for generating electrical power, and an electronic controller. It will thus be appreciated that the disclosed embodiments are not limited to any specific deployment location of the navigational sensors in the drill string.

The example rotary steerable tool 760 and/or MWD tool 750 depicted include(s) tri-axial accelerometer and tri-axial magnetometer navigation sensor sets. These navigation sensors may include substantially any suitable available devices. Suitable accelerometers for use in sensor set may include, for example, conventional Q-flex types accelerometers or micro-electro-mechanical systems (MEMS) solid-state accelerometers. Suitable magnetic field sensors for use in sensor set may include, for example, conventional ring core flux gate magnetometers or magnetoresistive sensors. The navigations sensor may further optionally include gyroscopic sensors such as a rate gyro or a MEMS type gyro.

With continued reference to FIGS. 7 and 8, rotary steerable tool and/or MWD tool may further include a rotation rate sensor 869 configured to measure a difference in rotation rates between the roll-stabilized housing and the drill collar 862 (which is equal to the rotation rate of the collar when the roll-stabilized housing is geostationary). Substantially any suitable rotation rate sensors may be utilized, for example, including a sensor (or sensors) deployed in the roll-stabilized housing and one or more markers (such as magnetic markers) deployed on the collar. In example embodiments, the sensor(s) may send an electrical pulse to a controller each time one of the markers rotates by the sensor and the rotation rate may be computed from the time interval between pulses. In one example embodiment, the sensor includes a Hall-effect sensor and the markers may be magnetic markers, although the invention is expressly not limited in this regard.

Figure 9B:
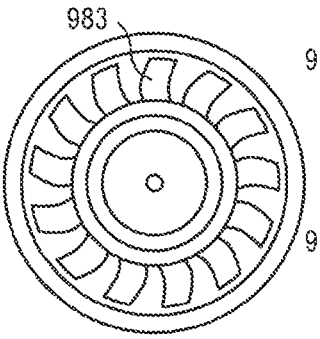
FIGS. 9A and 9B (collectively FIG. 9) depict a schematic representation of a roll-stabilized housing deployed in a downhole tool, according to at least one embodiment of the present disclosure.
Figure 9A:
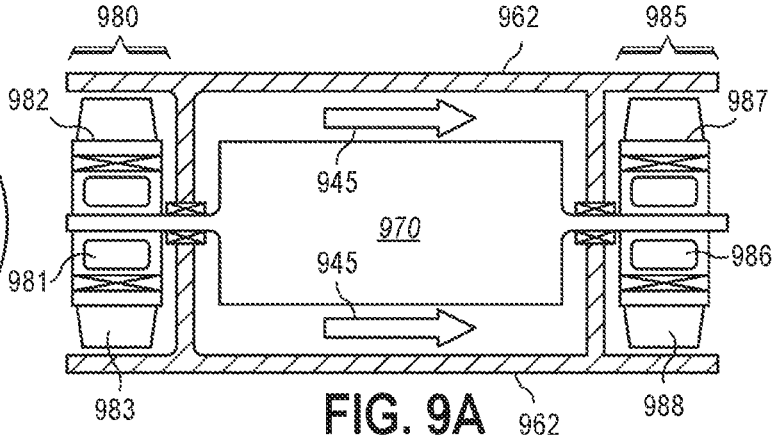

FIGS. 9A and 9B (collectively FIG. 9) depict a schematic representation of one example of a roll-stabilized housing 970 (e.g., a sensor housing) deployed in a rotary steerable tool (FIG. 8). It will be understood that this is merely an example and that the disclosed method embodiments are not limited to any particular roll-stabilizing mechanism or configuration. In the depicted example, the roll-stabilized housing is mounted on bearings such that it is rotationally decoupled from (able to rotate independently with respect to) tool collar. In the depicted embodiment, first and second alternators 980, 985 (e.g., of the permanent magnet synchronous motor type) are separately mounted on opposing axial ends of the roll-stabilized housing 970. The corresponding stator windings 981, 986 are mechanically continuous with the roll-stabilized housing 970 (and are therefore rotationally coupled with the roll-stabilized housing). Corresponding rotors including permanent magnets 982, 987 are configured to rotate independently of both the roll-stabilized housing 970 and the tool collar 962. Impeller blades 983, 988 are mechanically contiguous with the corresponding rotors and span the annular clearance between the housing 970 and the tool collar 962 such that they rotate, for example, in opposite directions with the flow of drilling fluid 945 through the tool.

In the depicted example, the rotational orientation of the housing 970 may be controlled by the co-action of the alternators 980 and 985 in combination with feedback provided by the navigation sensors (e.g., accelerometers and/or magnetometers) deployed in the housing. The impellers 983 and 988 being configured to rotate in opposite directions apply corresponding opposite torques to the housing 970. The amount of electrical load on the torque generators 980 and 985 may be changed in response to feedback from the at least one of the sensors to vary the applied torques and thereby control the orientation of the housing. When used in a rotary steerable system, the control unit may have an output shaft that is rigidly connected to a rotary valve. The rotary valve directs fluid from the flow to an actuator in a steering bias unit, which then acts to steer the tool (e.g., by acting on the wellbore wall or by acting on a bit shaft). Thus, by controlling the orientation of the control unit, the orientation of the rotary valve is controlled, thereby providing steering control.

With continued reference to FIGS. 8 and 9, it will be appreciated that rotation of the collar or roll-stabilized housing in the Earth's magnetic field may cause an eddy current (or currents) therein (owing to the Lorentz force created by the Earth's field penetrating the rotating members). These eddy currents may create additional magnetic fields along a radial axis of the BHA and thereby interfere with the magnetic field measurements (made by a sensor 867). Moreover, the magnitude of the eddy currents and the corresponding interfering magnetic fields may depend on the size and geometry of the drill collar, the rotation rate of the drill collar and/or housing, and the type of drilling fluid utilized in the drilling operation. There is a need for methods to compensate (account) for interfering magnetic fields generated by eddy currents (particularly since these fields can change during the drilling operation).

It will also be appreciated that magnetometer measurements can be biased and that the bias may be dependent on the magnetization of the collar and other tool structures in the vicinity of the sensors. While multi-station analysis (MSA) has been used to remove a constant bias offset, it has been found that the bias offset can change within (during) a drilling operation and that surface data and measurements are generally not sufficient to model the changing bias offset over time and depth while drilling. There is a further need for methods to compensate (account) for offset bias of the magnetometers, particularly offset bias that changes during a drilling operation.

Figure 10:
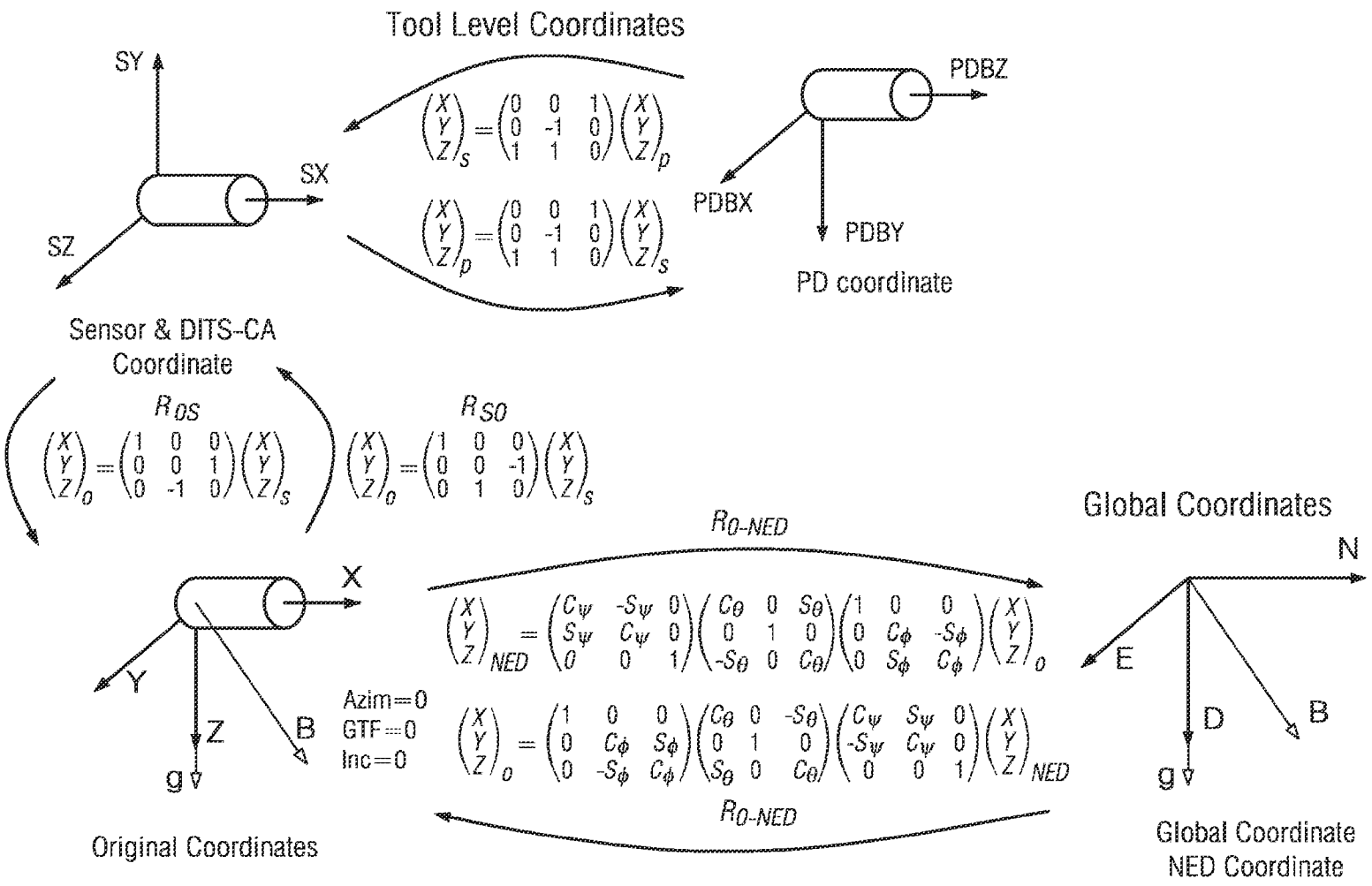
FIG. 10 depicts multiple coordinate systems and their relationship to one another, according to at least one embodiment of the present disclosure.

FIG. 10 depicts multiple coordinate systems and their relationship to one another. A global north-east-down (NED) coordinate system is commonly used in the industry for simplicity (with north and east referring to north and east directions on the surface of the earth and down referring to a direction pointing directly towards the gravitational center of the earth). Multiple commonly used tool coordinate systems are also shown in FIG. 10, including a PowerDrive (PD) coordinate system, a Sensor (S) coordinate system, and an Original (O) coordinate system. FIG. 10 further shows mathematical transformations that may be used to convert measurements from one coordinate system to another. As used herein, the original O coordinate system is defined to align with the NED coordinate system at zero azimuth, zero toolface, and zero pitch angle (the pitch angle is defined as the inclination minus ninety degrees). The relationship between the NED and original (tool) coordinate systems may be expressed mathematically, for example, as follows:

$$\begin{pmatrix} X \\ Y \\ Z \end{pmatrix}_{NED} = R_{NED-O}\begin{pmatrix} X \\ Y \\ Z \end{pmatrix}_{O} = \begin{pmatrix} C_\psi & -S_\psi & 0 \\ S_\psi & C_\psi & 0 \\ 0 & 0 & 1 \end{pmatrix}\begin{pmatrix} C_\theta & 0 & S_\theta \\ 0 & 1 & 0 \\ -S_\theta & 0 & C_\theta \end{pmatrix}\begin{pmatrix} 1 & 0 & 0 \\ 0 & C_\phi & -S_\phi \\ 0 & S_\phi & C_\phi \end{pmatrix}\begin{pmatrix} X \\ Y \\ Z \end{pmatrix}_{O}$$

$$\begin{pmatrix} X \\ Y \\ Z \end{pmatrix}_{O} = R_{O-NED}\begin{pmatrix} X \\ Y \\ Z \end{pmatrix}_{NED} = \begin{pmatrix} 1 & 0 & 0 \\ 0 & C_\phi & S_\phi \\ 0 & -S_\phi & C_\phi \end{pmatrix}\begin{pmatrix} C_\theta & 0 & -S_\theta \\ 0 & 1 & 0 \\ S_\theta & 0 & C_\theta \end{pmatrix}\begin{pmatrix} C_\psi & S_\psi & 0 \\ -S_\psi & C_\psi & 0 \\ 0 & 0 & 1 \end{pmatrix}\begin{pmatrix} X \\ Y \\ Z \end{pmatrix}_{NED}$$

where C represents cosine, S represents sine, $\psi$ represents the azimuth, $\phi$ represents the gravity tool face, and $\theta$ represents the pitch angle. For a coordinate system employing inclination (rather than pitch angle), the relationship between the NED and original coordinate systems may be expressed, for example, as follows:

$$\begin{pmatrix} X \\ Y \\ Z \end{pmatrix}_{NED} = R_{NED-O}\begin{pmatrix} X \\ Y \\ Z \end{pmatrix}_{O} = \begin{pmatrix} C_\psi & -S_\psi & 0 \\ S_\psi & C_\psi & 0 \\ 0 & 0 & 1 \end{pmatrix}\begin{pmatrix} S_I & 0 & -C_I \\ 0 & 1 & 0 \\ C_I & 0 & S_I \end{pmatrix}\begin{pmatrix} 1 & 0 & 0 \\ 0 & C_\phi & -S_\phi \\ 0 & S_\phi & C_\phi \end{pmatrix}\begin{pmatrix} X \\ Y \\ Z \end{pmatrix}_{O}$$

$$\begin{pmatrix} X \\ Y \\ Z \end{pmatrix}_{O} = R_{O-NED}\begin{pmatrix} X \\ Y \\ Z \end{pmatrix}_{NED} = \begin{pmatrix} 1 & 0 & 0 \\ 0 & C_\phi & S_\phi \\ 0 & -S_\phi & C_\phi \end{pmatrix}\begin{pmatrix} S_I & 0 & C_I \\ 0 & 1 & 0 \\ -C_I & 0 & S_I \end{pmatrix}\begin{pmatrix} C_\psi & S_\psi & 0 \\ -S_\psi & C_\psi & 0 \\ 0 & 0 & 1 \end{pmatrix}\begin{pmatrix} X \\ Y \\ Z \end{pmatrix}_{NED}$$

One aspect of the disclosed embodiments is the realization that triaxial magnetometer measurements may be modelled, for example, as follows:

$$\begin{pmatrix} B_x \\ B_y \\ B_z \end{pmatrix}_i = \begin{pmatrix} 1 & 0 & 0 \\ 0 & 1 & -\gamma_s\omega_s \\ 0 & \gamma_s\omega_s & 1 \end{pmatrix}\begin{pmatrix} 1 & 0 & 0 \\ 0 & 1 & -\gamma_c\omega_c \\ 0 & \gamma_c\omega_c & 1 \end{pmatrix}\begin{pmatrix} \widehat{B_x} \\ \widehat{B_y} \\ \widehat{B_z} \end{pmatrix} + \begin{pmatrix} b_x \\ b_y \\ b_z \end{pmatrix} + \begin{pmatrix} \varepsilon_{B_x} \\ \varepsilon_{B_y} \\ \varepsilon_{B_z} \end{pmatrix}$$

where $B_x$, $B_y$, and $B_z$ represent the triaxial magnetometer measurements in the original coordinate $\widehat{B_x}$ system at survey station (survey location) i, $\widehat{B_x}$, $\widehat{B_x}$, and $\widehat{B_x}$ represent the true magnetic field vector (or true magnetic field measurements representative of reality), $b_x$, $b_y$, and $b_z$ represent the magnetometer bias, $\gamma_c$ and $\gamma_s$ represent eddy current compensation terms for drill collar rotation $\gamma_c$ and roll-stabilized sensor housing rotation $\gamma_s$, $\omega_c$ and $\omega_s$ represent the rotation rates (angular frequency) of the drill collar and sensor housing, and $\varepsilon_{B_x}$, $\varepsilon_{B_y}$, and $\varepsilon_{B_z}$ represent error terms.

It will be appreciated in certain operations, or at various times within an operation, that the sensor housing rotation rate may be zero or near zero such that the above equation reduces to the following:

$$\begin{pmatrix} B_x \\ B_y \\ B_z \end{pmatrix}_i = \begin{pmatrix} 1 & 0 & 0 \\ 0 & 1 & -\gamma_c\omega_c \\ 0 & \gamma_c\omega_c & 1 \end{pmatrix}\begin{pmatrix} \widehat{B_x} \\ \widehat{B_y} \\ \widehat{B_z} \end{pmatrix} + \begin{pmatrix} b_x \\ b_y \\ b_z \end{pmatrix} + \begin{pmatrix} \varepsilon_{B_x} \\ \varepsilon_{B_y} \\ \varepsilon_{B_z} \end{pmatrix}$$

In the NED coordinate system, the gravity and magnetic fields may be defined as follows:

$$\begin{pmatrix} \widehat{G_N} \\ \widehat{G_E} \\ \widehat{G_D} \end{pmatrix}_{NED} = \begin{pmatrix} 0 \\ 0 \\ G \end{pmatrix}$$

-continued $$\begin{pmatrix} \widehat{B_N} \\ \widehat{B_E} \\ \widehat{B_D} \end{pmatrix}_{NED} = \begin{pmatrix} B\cos(D) \\ 0 \\ B\sin(D) \end{pmatrix}$$

where G represents the total gravitational field at the location, B represents the total magnetic flux at the location, and D represents the dip angle of the magnetic flux at the location. Assuming that the true azimuth, inclination, and toolface are known, the true gravity vector and magnetic field vector in the original coordinate system (e.g., at the tool) may be expressed as follows:

$$\begin{pmatrix} \widehat{G_X} \\ \widehat{G_Y} \\ \widehat{G_Z} \end{pmatrix}_O = R_{O-NED}\begin{pmatrix} 0 \\ 0 \\ G \end{pmatrix} = \begin{pmatrix} G\cos I \\ G\sin I\sin\phi \\ G\sin I\cos\phi \end{pmatrix}$$

$$\begin{pmatrix} \widehat{B_X} \\ \widehat{B_Y} \\ \widehat{B_Z} \end{pmatrix}_O = R_{O-NED}\begin{pmatrix} B\cos(D) \\ 0 \\ B\sin(D) \end{pmatrix} = B\begin{pmatrix} \cos I\sin D + \cos\psi\cos D\sin I \\ \sin D\sin I\sin\phi - \cos D(\cos\phi\sin\psi + \cos\psi\cos I\sin\phi) \\ \cos D(\sin\psi\sin\phi - \cos\psi\cos I\cos\phi) + \cos\phi\sin D\sin I \end{pmatrix}$$

The magnetometer bias may be thought of as a semi-constant parameter. For example, at the survey station i, if the true magnetic field is $(\widehat{B_x}\ \widehat{B_x}\ \widehat{B_x})^T$ the bias offset may be expressed as follows:

$$\begin{pmatrix} B_x \\ B_y \\ B_z \end{pmatrix}_i = \begin{pmatrix} \widehat{B_x} \\ \widehat{B_y} \\ \widehat{B_z} \end{pmatrix} + \begin{pmatrix} b_x \\ b_y \\ b_z \end{pmatrix}$$

Figure 11:
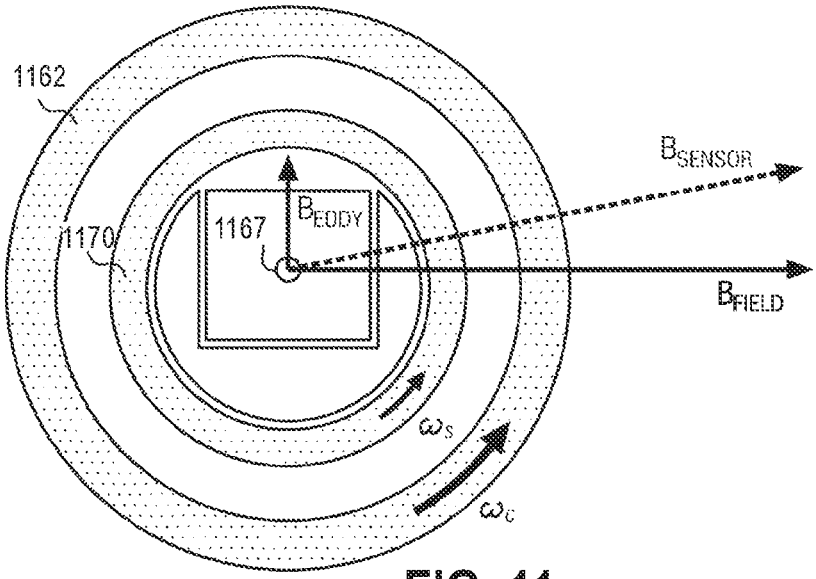
FIG. 11 depicts a cross section of an example rotary steerable tool including schematic magnetic field vectors, according to at least one embodiment of the present disclosure.

Turning now to FIG. 11, as described above, an interfering magnetic field may result, for example, from an eddy current (or eddy currents) in the rotating drill collar 1162 and/or sensor housing 1170. Rotation of the collar and/or housing in the Earth's magnetic field $B_{field}$ may generate an eddy current in the collar and/or housing (owing to the Lorentz force created $b_{eddy}$ the Earth's field penetrating rotating collar and/or housing). The interfering field $B_{eddy}$ is directed in the radial direction as shown such that the measured field $B_{sensor}$ may deviate from the external field $B_{field}$. In this disclosure it is assumed that the amplitude of $B_{eddy}$ (the magnetic field induced by eddy current) is proportional to the strength of the external magnetic field $B_{field}$, the rotational speed of the collar $\omega_c$ and/or the sensor housing $\omega_s$, and the eddy current coefficients $\gamma_c$ and $\gamma_s$. It is further assumed that the induced magnetic field $B_{eddy}$ is orthogonal to the external magnetic field owing to the symmetry of the collar 1162 and sensor housing 1170.

Based on the foregoing assumptions the induced magnetic fields from eddy currents in the drill collar 1162 and sensor housing 1170 may be expressed, for example, as follows:

$$\begin{pmatrix} B_x \\ B_y \\ B_z \end{pmatrix}_i = \begin{pmatrix} 1 & 0 & 0 \\ 0 & 1 & -\gamma_s\omega_s \\ 0 & \gamma_s\omega_s & 1 \end{pmatrix} \begin{pmatrix} 1 & 0 & 0 \\ 0 & 1 & -\gamma_c\omega_c \\ 0 & \gamma_c\omega_c & 1 \end{pmatrix} \begin{pmatrix} \widetilde{B_x} \\ \widetilde{B_y} \\ \widetilde{B_z} \end{pmatrix}$$

In operations in which (or at times at which) the sensor housing 1170 is essentially geostationary (non-rotating), the preceding equation may be simplified as follows:

$$\begin{pmatrix} B_x \\ B_y \\ B_z \end{pmatrix}_i = \begin{pmatrix} \widetilde{B_x} \\ \widetilde{B_y} \\ \widetilde{B_z} \end{pmatrix} + \gamma_c\omega_c \begin{pmatrix} 0 \\ -\widetilde{B_z} \\ \widetilde{B_y} \end{pmatrix} = \begin{pmatrix} 1 & 0 & 0 \\ 0 & 1 & -\gamma_c\omega_c \\ 0 & \gamma_c\omega_c & 1 \end{pmatrix} \begin{pmatrix} \widetilde{B_x} \\ \widetilde{B_y} \\ \widetilde{B_z} \end{pmatrix}$$

As shown above, the eddy current effect may be approximated as a rotation of a misalignment matrix around the tool axis (the x-axis in the original coordinate system). An accurate estimate of the eddy current compensation terms $\gamma_c$ and $\gamma_s$ is needed to accurately compensate (correct) the magnetic field measurements (made by a sensor 1167) for eddy current effects.

Figure 12A:
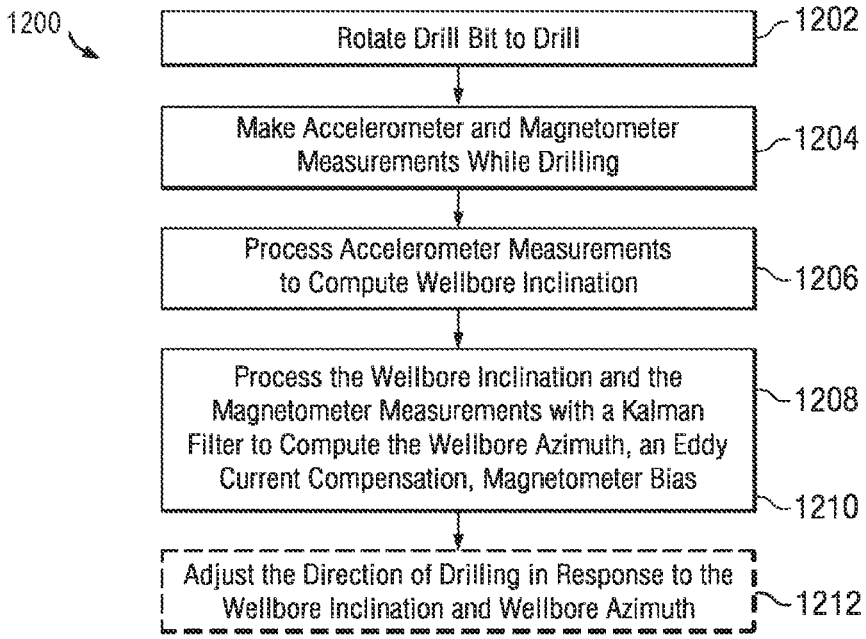
FIGS. 12A and 12B (collectively FIG. 12) depict flow charts of example methods for drilling a subterranean wellbore, according to at least one embodiment of the present disclosure.
Figure 12B:
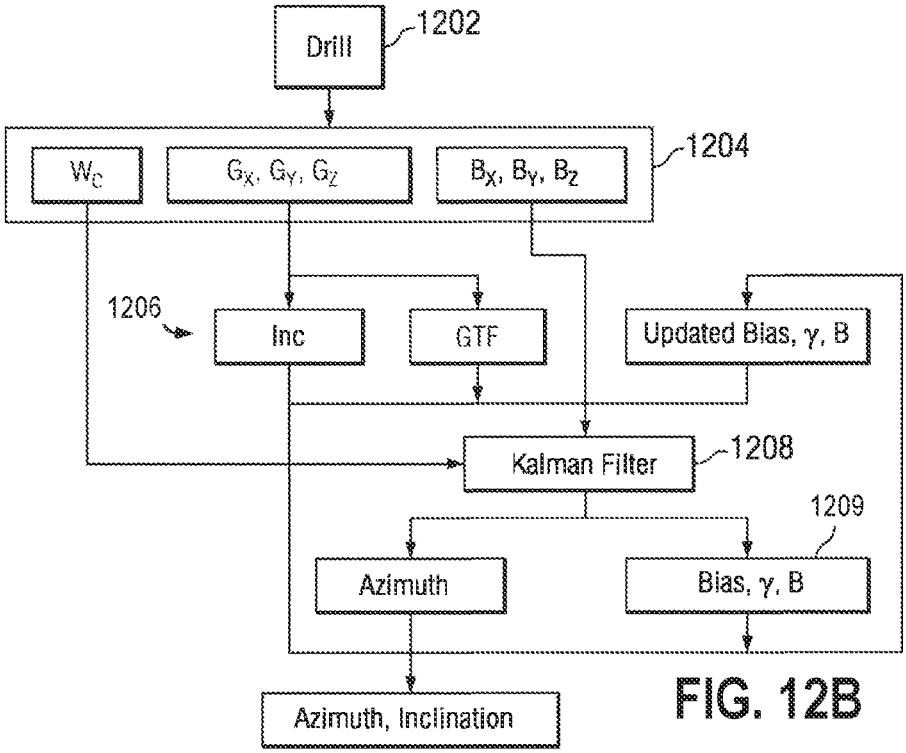

FIGS. 12A and 12B (collectively FIG. 12) depict example methods 1200 for drilling a subterranean wellbore. The methods 1200 may include deploying a drill string, including a BHA, in the wellbore, e.g., as shown on FIG. 7. The BHA may include a rotary steerable drilling tool including a drill collar and a roll-stabilized sensor housing, e.g., as shown on FIGS. 8 and 9. The BHA is rotated in the wellbore at 1202, for example, to drill. Triaxial magnetic field measurements and triaxial accelerometer measurements (gravitational field measurements) are made using corresponding sensors located in a roll-stabilized housing at 1204. Rotation rates of the drill collar and/or the sensor housing may also be measured at 1204. The triaxial accelerometer measurements may be evaluated at 1206 to compute wellbore inclination I, total gravity G, and the gravity tool face GTF of the sensor housing. The wellbore inclination, gravity tool face, the magnetic field measurements, and the latest bias offset, eddy current compensation, and total magnetic field may be processed with a Kalman filter at 1208 to compute the wellbore azimuth $\psi$, the derivative of the wellbore azimuth with respect to time $\dot{\psi}$, an updated magnetometer bias, total gravity, and eddy current compensation values as indicated at 1209. The wellbore inclination and wellbore azimuth may be optionally used for wellbore position and trajectory control at 1210 while drilling continues in 1202. For example, the direction of drilling in 1212 may be adjusted in response to the inclination and azimuth (e.g., by adjusting the positions of blades or other actuating components in a rotary steerable tool) to continue drilling along a predetermined path or some other desired path.

In accordance with at least one embodiment of the present disclosure, the wellbore azimuth $\psi$ or toolface may be determined using a gyroscope survey. For example, the roll-stabilized unit may include one or more gyroscopic survey units. The gyroscopic survey units may prepare an azimuth survey to determine the azimuth and/or toolface of the steering unit. In some embodiments, the techniques discussed herein with respect to determining the magnetic bias may utilize the wellbore azimuth $\psi$ or toolface determined by the gyroscopic survey tool. Utilizing the surveyed wellbore azimuth may help to improve the accuracy and/or precision of the magnetic bias determination. In some embodiments, utilizing the measured wellbore azimuth may allow accurate survey measurements in the zone of exclusion, or in the zone in which magnetic surveys are not reliable. As discussed herein, such zones of exclusion include the directions at or near 90° (e.g., east) and 270° (e.g., west).

An example state model may be defined, for example, as follows:

$$\beta_{k+1} = G\beta_k + \omega$$

In one example:

$$\beta_{k+1} = \begin{pmatrix} \psi \\ \dot{\psi} \\ \gamma \\ B \\ b_x \\ b_y \\ b_z \end{pmatrix}_{k+1}$$

where $\psi$ represents the wellbore azimuth, $\dot{\psi}$represents the derivative of the wellbore azimuth with respect to time, $\gamma$ represents the eddy current compensation term for the drill collar or the sensor housing, B represents the total magnetic field, and $b_x$, $b_y$, and $b_z$ represent the magnetometer bias. A measurement model may be defined, for example, as follows:

$$B_i = \begin{pmatrix} B_x \\ B_y \\ B_z \end{pmatrix}_i = H(\psi, \gamma, B, b_x, b_y, b_z, I, D, \phi) + \begin{pmatrix} \varepsilon_{B_x} \\ \varepsilon_{B_y} \\ \varepsilon_{B_z} \end{pmatrix}$$

where H represents the observation model function. The extended Kalman filter may be configured to solve the problem and compute $\psi$, $\dot{\psi}$, $\gamma$, B, $b_x$, $b_y$, and $b_z$. For this example, the system prediction step may be expressed as follows:

$$\widehat{\beta_{k+1}} = G\beta_k$$

$$\widehat{C_{k+1}} = GC_kG^T + R$$

While embodiments of the present disclosure may discuss computing the wellbore azimuth $\psi$, it should be understood that, when the gyroscopic azimuth measurement is utilized, the extended Kalman filter may not be used to compute $\psi$ and/or $\dot{\psi}$.

The Kalman gain calculation may be given as follows:

$$K_{k+1} = \widehat{C_{k+1}^{-}} J^T (J \widehat{C_{k+1}^{-}} J^T + Q)^T$$

The state vector and covariance matrix may be updated with the measurements as follows:

$$\beta_{k+1} = \widehat{\beta_{k+1}^{-}} + K_{k+1}(z - H)$$

$$C_{k+1} = (E - K_{k+1}H)\widehat{C_{k+1}^{-}}$$

where $\beta$ is the state vector which includes $(\psi\ \dot{\psi}\ \gamma\ B\ b_x\ b_y\ b_z)^T$, G is the system matrix (and is not to be confused with the total gravity), R is the covariance matrix for system uncertainty, Q is the measurement noise covariance matrix, and J is the Jacobian matrix which is the differential of H with respect to $\beta$. The contents of the Jacobian matrix may be obtained, for example, using the symbolic math toolbox of MATLAB.

In some embodiments, when the azimuth is determined using the gyroscopic survey, the Jacobian matrix of K over x is given by:

$$J_k = \frac{\partial K}{\partial x}$$

where X is the system vector:

$$x = \begin{pmatrix} D \\ B \\ b_x \\ b_y \\ b_z \end{pmatrix}$$

If multiple surveys are taken during the drilling process, with various toolface angles but without changes of inclination and/or azimuth, then:

$$\begin{pmatrix} B_1 \\ \vdots \\ B_n \end{pmatrix} = \begin{pmatrix} K_1 \\ \vdots \\ K_n \end{pmatrix}_x + \begin{pmatrix} w_1 \\ \vdots \\ w_n \end{pmatrix}$$

The parameters x can be estimated using:

$$x_{j+1} = x_j + \left( \begin{pmatrix} J_{K1} \\ \vdots \\ J_{Kn} \end{pmatrix}_{x_j}^T \begin{pmatrix} J_{K1} \\ \vdots \\ J_{Kn} \end{pmatrix}_{x_j} \right)^{-1} \begin{pmatrix} J_{K1} \\ \vdots \\ J_{Kn} \end{pmatrix}_{x_j}^T \left( \begin{pmatrix} B_1 \\ \vdots \\ B_n \end{pmatrix} - \begin{pmatrix} K_1 \\ \vdots \\ K_n \end{pmatrix}_{x_j} \right)$$

This recursive process may end at the process convergence:

$$err = norm(x_{j+1} - x_j)$$

In accordance with at least one embodiment of the present disclosure, the azimuth may be calculated while performing drilling activities. For example, the gyroscope survey may measure the toolface or gyroscopic azimuth of the tool while the drill string is rotating. Surveying the toolface while performing drilling activities, in combination with the magnetic bias determination discussed herein, may help generate a more responsive real-time survey. This real-time survey may be more responsive to sudden changes in the azimuth. This may allow the drilling operator to implement changes to the drilling system, including changes to the RSS, more quickly, thereby improving the steering accuracy and/or precision.

The system azimuth model may be estimated by:

$$\begin{pmatrix} \psi \\ \dot{\psi} \end{pmatrix}_{k+1} = \begin{pmatrix} 1 & dt \\ 0 & 1 \end{pmatrix} \begin{pmatrix} \psi \\ \dot{\psi} \end{pmatrix}_k + \begin{pmatrix} 0 \\ w_A \end{pmatrix}$$

The observation model may be identified by:

$$\begin{pmatrix} \psi_{magk} \\ \dot{\psi}_{gyrok} \end{pmatrix} = \begin{pmatrix} 1 & 0 \\ 0 & 1 \end{pmatrix} \begin{pmatrix} \psi \\ \dot{\psi} \end{pmatrix}_k + \begin{pmatrix} \varepsilon_{\psi mag} \\ \varepsilon_{\dot{\psi} gyro} \end{pmatrix}$$

where $\psi_{mag\ k}$ is azimuth angle estimated by 6-axis magnetic survey reading. $\dot{\psi}_{gyro\ k}$ is rate of azimuth change estimated by gyro signal. $\dot{\psi}_{gyro}$ may be calculated by:

$$\dot{\psi}_{gyro} = (\omega_y \sin\phi + \omega_z \cos\phi)\sec\theta$$

where $\phi$ is toolface, $\omega_y$, $\omega_z$ are gyro reading for y and z axis, and $\theta$ is pitch angle. This smoothing may further be applied to the inclination and the toolface using the survey measurements from the gyroscope survey.

Figure 13A:
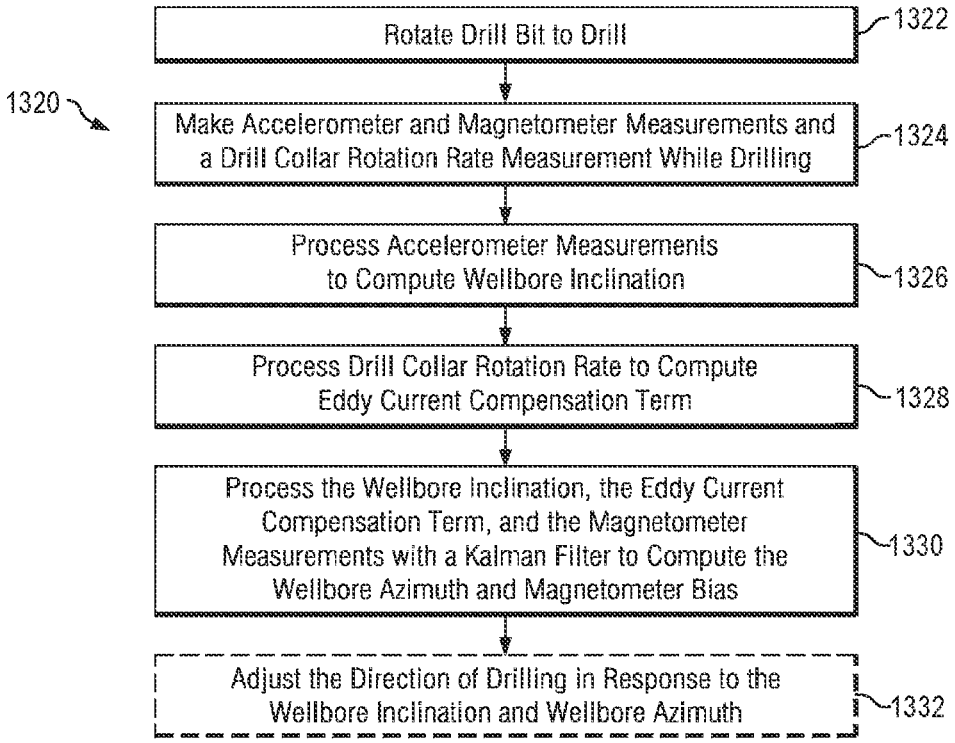
FIGS. 13A and 13B (collectively FIG. 13) depict flow charts of example methods for drilling a subterranean wellbore, according to at least one embodiment of the present disclosure.
Figure 13B:
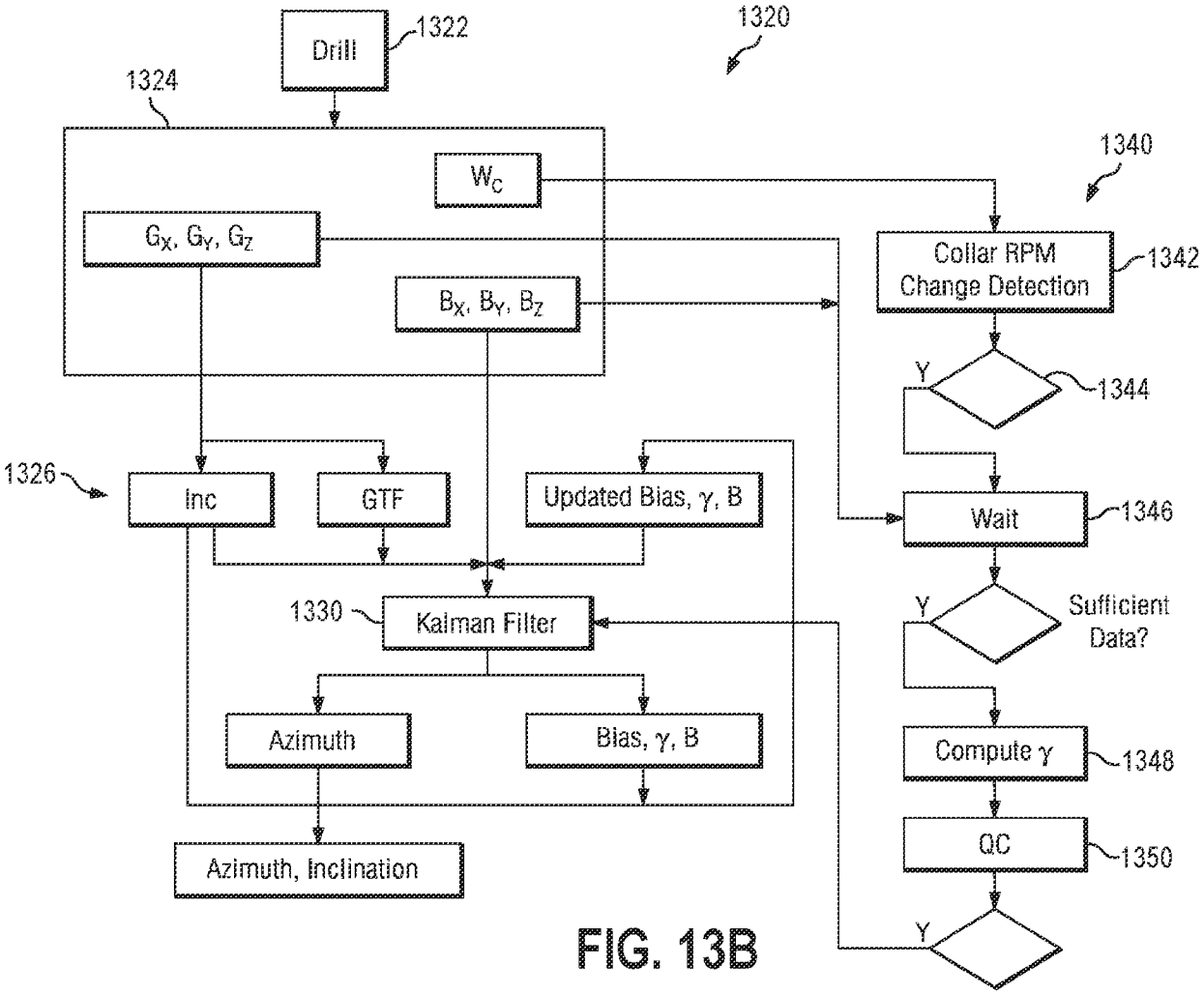

FIGS. 13A and 13B (collectively FIG. 13) depict flow charts of example methods 1320 for drilling a subterranean wellbore. These methods 1320 may include deploying a BHA in a wellbore in which the BHA includes a rotary steerable drilling tool having a roll-stabilized sensor housing as described above with respect to FIG. 12 (and FIGS. 8 and 9). The BHA is rotated in the wellbore at 1322, for example, to drill. Triaxial magnetic field measurements and triaxial accelerometer measurements (gravitational field measurements) are made using corresponding sensors located in the roll-stabilized housing at 1324. Rotation rates of the drill collar may also be measured at 1324. The triaxial accelerometer measurements may be evaluated at 1326 to compute wellbore inclination I, total gravity G, and the gravity tool face GTF of the sensor housing.

In FIG. 13A, an eddy current compensation term $\gamma$ may be computed from the measured collar rotation rate (or a change in the collar rotation rate) at 1328 as also shown at 1340 on FIG. 13B. The wellbore inclination, gravity tool face, the magnetic field measurements, and the latest magnetometer bias, eddy current compensation term, and total magnetic field may then be processed with a Kalman filter at 1330 to compute the wellbore azimuth $\psi$, the derivative of the wellbore azimuth with respect to time 4*k*, and updated magnetometer bias and total gravity. The wellbore inclination and wellbore azimuth may be optionally used for wellbore position and trajectory control at 1332 while drilling continues in 1322. For example, the direction of drilling in 1322 may be adjusted in response to the inclination and azimuth (e.g., by adjusting the positions of blades or other actuating components in a rotary steerable tool) to continue drilling along a predetermined path.

As discussed above with respect to FIG. 12, the wellbore azimuth may be directly measured using the gyroscopic survey tool. This may help to increase the accuracy of the eddy current compensation.

It will be appreciated that methods in FIG. 13A and FIG. 13B are similar to methods in FIGS. 12A and 12B, in that they utilize a Kalman filter to estimate the wellbore azimuth, but differ therefrom in that the eddy current compensation term $\gamma$ is updated independently from the Kalman filter, for example, when a significant change in collar (or sensor housing) rotation has been detected. An example state model for the Kalman filter 1330 may be given as follows (note that the example model will not include the eddy current compensation term $\gamma$):

$$\beta_{k+1} = G\beta_k + \omega$$

In one example:

$$\beta_{k+1} = \begin{pmatrix} \psi \\ \dot{\psi} \\ B \\ b_x \\ b_y \\ b_z \end{pmatrix}_{k+1}$$

The measurement model may be defined, for example, as given above where $\gamma$ is obtained using the separate algorithm. The contents of example Jacobian matrix of H may be obtained as also described above.

The eddy current compensation term $\gamma$ may be estimated, for example, from a change in angle X when the rotation rate changes. It will be appreciated that angle X is the angle between the gravity and magnetic field vectors in the y-z plane (the cross axial plane perpendicular to the axis of the BHA) and may be computed, for example, as follows:

$$X = \operatorname{acos}\left(\frac{B_y G_y + B_z G_z}{|B_{yz}||G_{yz}|}\right)$$

where $|B_{yz}|$ and $|G_{yz}|$ represent the magnitudes of the cross-axial (the yz) components of the magnetic field measurements and the accelerometer measurements. In the absence of eddy currents, angle X is essentially constant. However, angle X has been found to change with changing collar rotation rate (e.g., increase with increasing rotation rate). This dependency on the collar rotation rate may be used to estimate the eddy current compensation term $\gamma$ (and to estimate changes in the eddy current compensation term with a changing rotation rate of the collar). An example error model for angle X is given below:

$$\operatorname{var}(dX) = \frac{\sigma_B^2}{B^2\left(1 - (\cos\psi\cos D\sin I + \sin D\cos I)^2\right)} + \frac{\sigma_G^2}{G^2\sin^2 I}$$

where $\sigma$(dB) and $\sigma$(dG) are standard deviations of the noise level of the magnetometer ($\varepsilon_{B_x}$) and accelerometer ($\varepsilon_{G_x}$) readings (including environmental noise). There are geometric conditions in which high errors can be observed. In general, high errors are observed when the tool axis is parallel to the reference magnetic or gravity field. More generally, it can be noisier when the wellbore is heading to the north in the northern hemisphere, heading to the south in the southern hemisphere, and the tool is vertical.

FIG. 14 schematically depicts a cross section of an example drill collar 1462 and indicates one example method for estimating the eddy current compensation term $\gamma$ from the relationship between angle X and the collar (or sensor housing) rotation rate (the sensor housing is not shown for simplicity of illustration). The cross axial magnetic field $B_{field}$ and the cross axial gravitational field $G_{yz}$ are indicated. As described above, angle X is the angle between these two vectors in the cross-axial plane. In this depiction, angle X is assumed to be $X_0$ when the collar rotation rate is zero, $X_1$ when the collar rotation rate is $\omega_1$, $X_2$ when the collar rotation rate is $\omega_2$, and so on. Based on the depiction in FIG. 14, angle X may be expressed in terms of the collar (and/or sensor housing) rotation rate, for example, as follows:

$$X_\omega = X_0 + \operatorname{atan}\gamma\omega$$

Taking the derivative of angle X with respect to $\omega$ and solving for $\gamma$ yields the following:

$$\frac{\partial X_\omega}{\partial\omega} = \frac{\gamma}{\gamma^2\omega^2 + 1} = \frac{1}{\alpha}$$

$$\gamma = \alpha\frac{1 - \sqrt{1 - 4\frac{\omega^2}{\alpha^2}}}{2\omega^2}$$

While the preceding equation provides a suitable solution for the eddy current compensation term $\gamma$, a simplified solution may be obtained by recognizing that the eddy current compensation term may be approximated as follows when $\omega^2 \ll \alpha^2$ (e.g., when $\omega^2/\alpha^2$ approaches zero):

$$\gamma \approx \alpha\frac{1 - \left(1 - 2\frac{\omega^2}{\alpha^2}\right)}{2\omega^2} = \frac{1}{\alpha} = \frac{\partial X_\omega}{\partial\omega}$$

This approximation provides for more robust computation of $\gamma$ and advantageously has an error of less than 1 percent for most drilling conditions (e.g., collar rotation rates of less than about 900 rpm).

With reference again to FIG. 13B, an updated eddy current compensation term $\gamma$ may be computed at 1340, for example, as follows. A change in the collar (or sensor housing) rotation rate may be detected at 1342. For example, a moving average may be applied to the collar rotation rate measurements at 1342 (e.g., a moving average over 25 or 50 measurements). The range (max-min) of the averaged rotation rates may be computed over predetermined time intervals at (e.g., in overlapping 2 minute windows) and compared with a threshold at 1344 (e.g., 50, 100, or 150 rpm). When the range is greater than the threshold, additional data is collected at 1346 and an updated eddy current compensation term $\gamma$ is computed at 1348, for example via computing a linear regression with the rotation rate and angle X.

The updated eddy current compensation term $\gamma$ may be optionally checked at 1350, for example, via evaluating the standard error oy, the fitting error $e_x$, and/or a difference from a reference obtained from a prior data set $|\gamma-\gamma_{ref}|$. When the quality control parameter(s) are within predetermined criteria, the updated eddy current compensation term $\gamma$ may be input into the Kalman filter. It will be appreciated that the updated eddy current compensation term $\gamma$ may be computed, for example, by averaging the new estimate with the previous estimate (or a fraction of the previous estimate) to reduce noise.

Figure 15B:
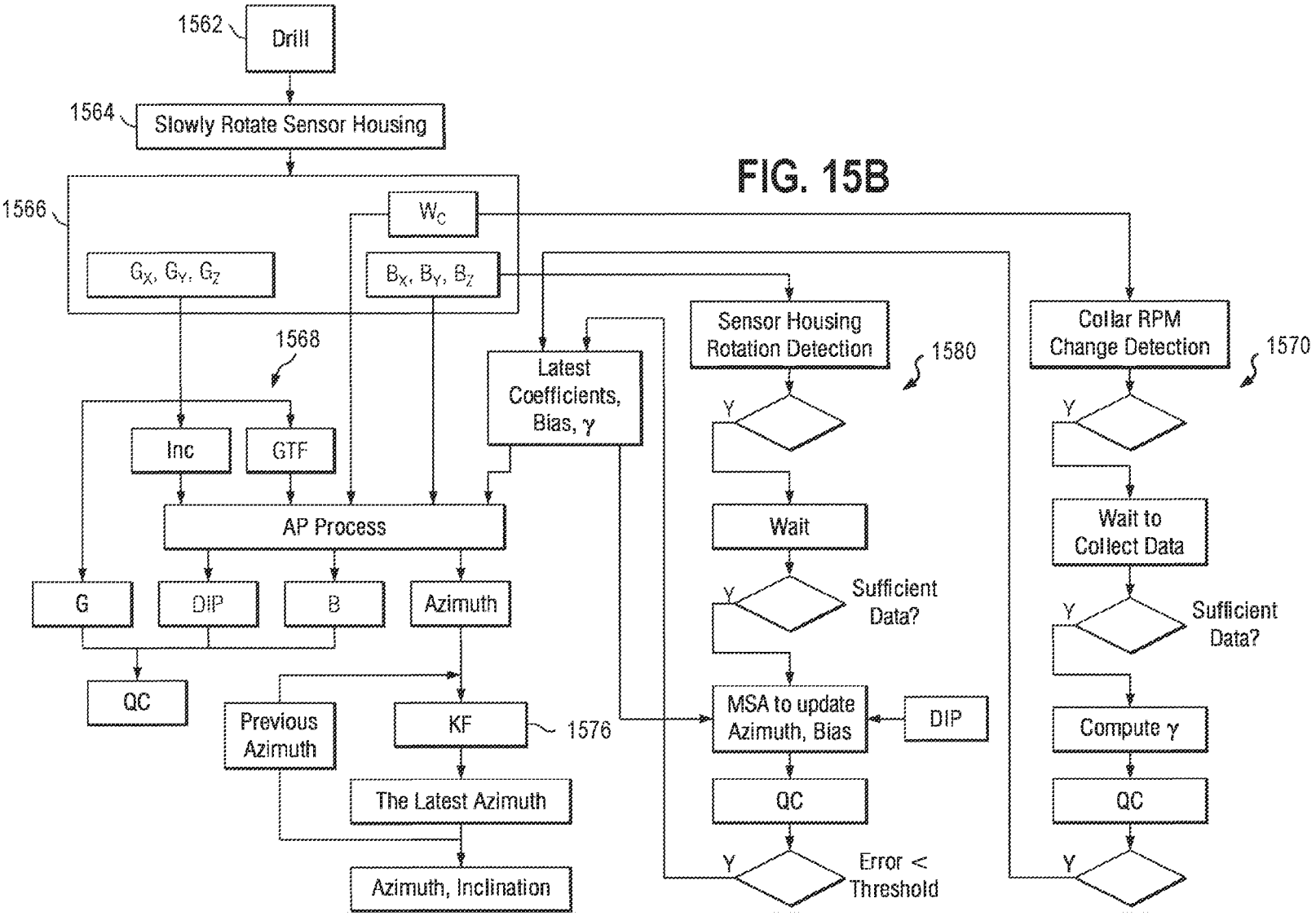

Turning now to FIGS. 15A and 15B (collectively FIG. 15), flow charts of still other example methods 1560 for drilling a subterranean wellbore are depicted. Methods 1560 in FIGS. 15A and 15B are similar to methods above in that they include deploying a BHA in a wellbore in which the BHA includes a rotary steerable drilling tool having a roll-stabilized sensor housing as described above. The BHA is rotated in the wellbore at 1562, for example, to drill. The roll-stabilized sensor housing is slowly rotated with respect to the wellbore at 1564. By slowly rotated it is meant that the sensor housing rotation rate is much less than the drill collar and/or BHA rotation rate. For example, the sensor housing rotation rate may be less than about 10 rpm. In one example embodiment described in more detail below by way of example, the sensor housing rotation rate is 4 rpm. In example embodiments, the roll-stabilized sensor housing may be geostationary during certain time intervals and slowly rotating during other time intervals. For example, at predetermined time or depth intervals the roll-stabilized sensor housing may slowly rotate for a predetermined time (e.g., 1 or 2 minutes) or a predetermined number of rotations (e.g., 2, 4, or 6 full rotations).

Triaxial magnetic field measurements and triaxial accelerometer measurements (gravitational field measurements) are made while the sensor housing is slowly rotating using the corresponding sensors located in the roll-stabilized housing at 1566. Rotation rates of the drill collar and/or the sensor housing may also be measured at 1566. The triaxial accelerometer measurements may be evaluated at 1568 to compute wellbore inclination I, total gravity G, and/or the gravity tool face GTF of the sensor housing.

Methods in FIGS. 15A and 15B are similar to methods in FIGS. 13A and 13B in that they further include computing an eddy current compensation term $\gamma$ (or terms) from the rotation rates (or change in rotation rates) of the drill collar and/or the sensor housing at 1570. For example, methods in 15A and 15B may include computing first and second eddy current compensation terms $\gamma_c$ and $\gamma_s$ from the rotation rates of the drill collar and the sensor housing. It will be appreciated that in certain tool embodiments, the sensor housing may be fabricated from a highly conductive aluminum alloy and that the eddy current effect can be significant even though the sensor housing rotates slowly compared to the collar.

The magnetometer measurements made at 1566 while the sensor housing is slowly rotating and the updated eddy current compensation terms are processed downhole at 1572 (also depicted at 1580 in FIG. 15B) to compute new magnetometer bias. This new magnetometer bias, the eddy current compensation terms, the magnetometer measurements, and the wellbore inclination are evaluated at 1574 to compute the wellbore azimuth $\psi$. The computed wellbore azimuth and a previous wellbore azimuth may be further processed at 1576 with a Kalman filter to compute a corrected (or smoothed or filtered) wellbore azimuth. The wellbore inclination and the wellbore azimuth may then be optionally used for wellbore position and trajectory control at 1578 while drilling continues in 1562. For example, the direction of drilling in 1562 may be adjusted in response to the inclination and azimuth (e.g., by adjusting the positions of blades or other actuating components in a rotary steerable tool) to continue drilling along a predetermined path.

With continued reference to FIG. 15, a state model for the Kalman filter may be given, for example, as follows:

$$\beta_{k+1} = G\beta_k + \omega$$

In one example:

$$\beta_k = \begin{pmatrix} \psi \\ \dot{\psi} \end{pmatrix}_k$$

The measurement model may be defined as given below in which the updated eddy current compensation term(s) $\gamma$ is/are computed as described above.

$$\psi_{temp\,k} = H\begin{pmatrix} \psi \\ \dot{\psi} \end{pmatrix}_k + \varepsilon_\psi$$

where $\psi_{temp\,k}$ is a temporary azimuth and H=(1 0). The latest $\psi_{temp\,k}$ may be derived from the modified magnetometer readings with the latest bias and $\gamma$. For example, the magnetometer reading may be corrected using the following equation.

$$\begin{pmatrix} \widetilde{B_x} \\ B_y \\ B_z \end{pmatrix}_i = \begin{pmatrix} 1 & 0 & 0 \\ 0 & 1 & -\gamma\omega \\ 0 & \gamma\omega & 1 \end{pmatrix}^{-1} \left( \begin{pmatrix} B_x \\ B_y \\ B_z \end{pmatrix}_i - \begin{pmatrix} b_x \\ b_y \\ b_z \end{pmatrix} \right)$$

Note that the magnetometer measurements are corrected to remove the bias and to compensate for the eddy current induced effect on the magnetometer measurements.

The azimuth, dip, and total magnetic field may be computed as follows from the measured accelerometer and magnetometer measurements.

$$\psi_{temp\,k} = \operatorname{atan}\left( \frac{\left(G_y\widetilde{B_x} - G_Z\hat{B}_y\right)\sqrt{G_x^2 + G_y^2 + G_z^2}}{\widetilde{B_x}\left(G_y^2 + G_z^2\right) - G_x\left(G_y\hat{B}_y + G_z\widetilde{B_x}\right)} \right)$$

$$D_k = \operatorname{asin}\left( \frac{\left(G_y\widetilde{B_x} + G_z\hat{B}_y + G_z\hat{B}_y\right)}{\sqrt{G_x^2 + G_y^2 + G_z^2}\sqrt{\hat{B}_x^{\,2} + \hat{B}_y^{\,2} + \hat{B}_z^{\,2}}} \right)$$

$$B_{tot\,k} = \sqrt{\hat{B}_x^{\,2} + \hat{B}_y^{\,2} + \hat{B}_z^{\,2}}$$

The system prediction step may be given as follows:

$$\widetilde{\beta_{k+1}} = G\beta_k$$

$$\widetilde{C_{k+1}} = GC_kG^T + R$$

The Kalman gain calculation is given below.

$$K_{k+1} = \widehat{C_{k+1}} H^T (H \widehat{C_{k+1}} H^T + Q)^T$$

The state vector and covariance matrix may be updated with measurements, for example, as follows:

$$\beta_{k+1} = \widehat{\beta_{k+1}} + K_{k+1}(\psi_{temp\,k} - H\widehat{\beta_{k+1}})$$

$$C_{k+1} = (E - K_{k+1}H)\widehat{C_{k+1}}$$

With continued reference to FIG. 15B, both eddy current compensation terms $\gamma_c$ and $\gamma_s$ and the magnetometer bias are updated independently from the Kalman filter. The bias components may be estimated using downhole multi-station analysis (MSA) at 1580. In this example embodiment, the bias determination includes detecting the slow sensor housing rotation at and collecting multiple sets of magnetometer measurements at (e.g., over at least 2 full rotations of the sensor housing). The magnetometer bias may be evaluated using MSA (as described in more detail below). An optional quality control step may be employed before outputting an updated magnetometer bias at.

An example measurement model for the MSA is given below.

$$B_i = \begin{pmatrix} B_x \\ B_y \\ B_z \end{pmatrix}_i = K(\psi, \gamma, B, b_x, b_y, b_z, I, D, \phi) + \begin{pmatrix} w_{B_x} \\ w_{B_y} \\ w_{B_z} \end{pmatrix}$$

where w ($w_{B_x}$, $w_{B_y}$, and $w_{B_z}$) represents the error and K may be defined from the measurement model discussed above:

The system vector x includes at least the magnetometer bias $b_x$, $b_y$, and $b_z$ and may optionally further include other known parameters such as B, D, and/or $\psi$. It may be advantageous to include one or more of the other known parameters, for example, to provide s quality control check on the computed bias. One example system vector x is given below:

$$x = \begin{pmatrix} \psi \\ B \\ b_x \\ b_y \\ b_z \end{pmatrix}$$

In this example, other parameters (such as I, $\gamma_s$, $\gamma_c$, $\omega_s$, $\omega_c$, D, and $\phi$) are considered to be known and are input as constants into the MSA model. Since the relationship between the system vector and the observed magnetic field measurements is non-linear, the problem may be advantageously solved using a non-linear optimization, such as the Gauss-Newton method to minimize w.

The Jacobian matrix of K over the system vector x is given below.

$$J_k = \frac{\partial K}{\partial x}$$

where the components of $J_K$ may be obtained as described above.

With continued reference to FIG. 15, multiple sets of accelerometer and magnetometer measurements may be made while slowly rotating the sensor housing. These multiple survey sets may be assumed to have the same azimuth and inclination (since the depth of the wellbore is essentially unchanged in the short period of time over which the multiple sets are collected), but different toolface angles (since the sensor housing is slowly rotating while the multiple sets are collected). The measurements ma be expressed, for example, as follows:

$$\begin{pmatrix} B_1 \\ \vdots \\ B_n \end{pmatrix} = \begin{pmatrix} K_1 \\ \vdots \\ K_n \end{pmatrix}_x + \begin{pmatrix} w_1 \\ \vdots \\ w_n \end{pmatrix}$$

The system vector x may be estimated by repeating the following equation:

$$x_{j+1} = x_j + \left( \begin{pmatrix} J_{K1} \\ \vdots \\ J_{Kn} \end{pmatrix}_{x_j}^T \begin{pmatrix} J_{K1} \\ \vdots \\ J_{Kn} \end{pmatrix}_{x_j} \right)^{-1} \begin{pmatrix} J_{K1} \\ \vdots \\ J_{Kn} \end{pmatrix}_{x_j}^T \left( \begin{pmatrix} B_1 \\ \vdots \\ B_n \end{pmatrix} - \begin{pmatrix} K_1 \\ \vdots \\ K_n \end{pmatrix}_{x_j} \right)$$

The recursive process ends when the process converges with the error being less than a threshold, where:

$$\text{error} = norm(x_{j+1} - x_j)$$

Though dip angle is used to estimate the bias, B is also estimated and may be used to QC the estimated bias parameters.

It will be appreciated that the above described procedure may be further utilized to correct accelerometer bias, for example, by including accelerometer bias terms in the system vector x.

Figure 16:
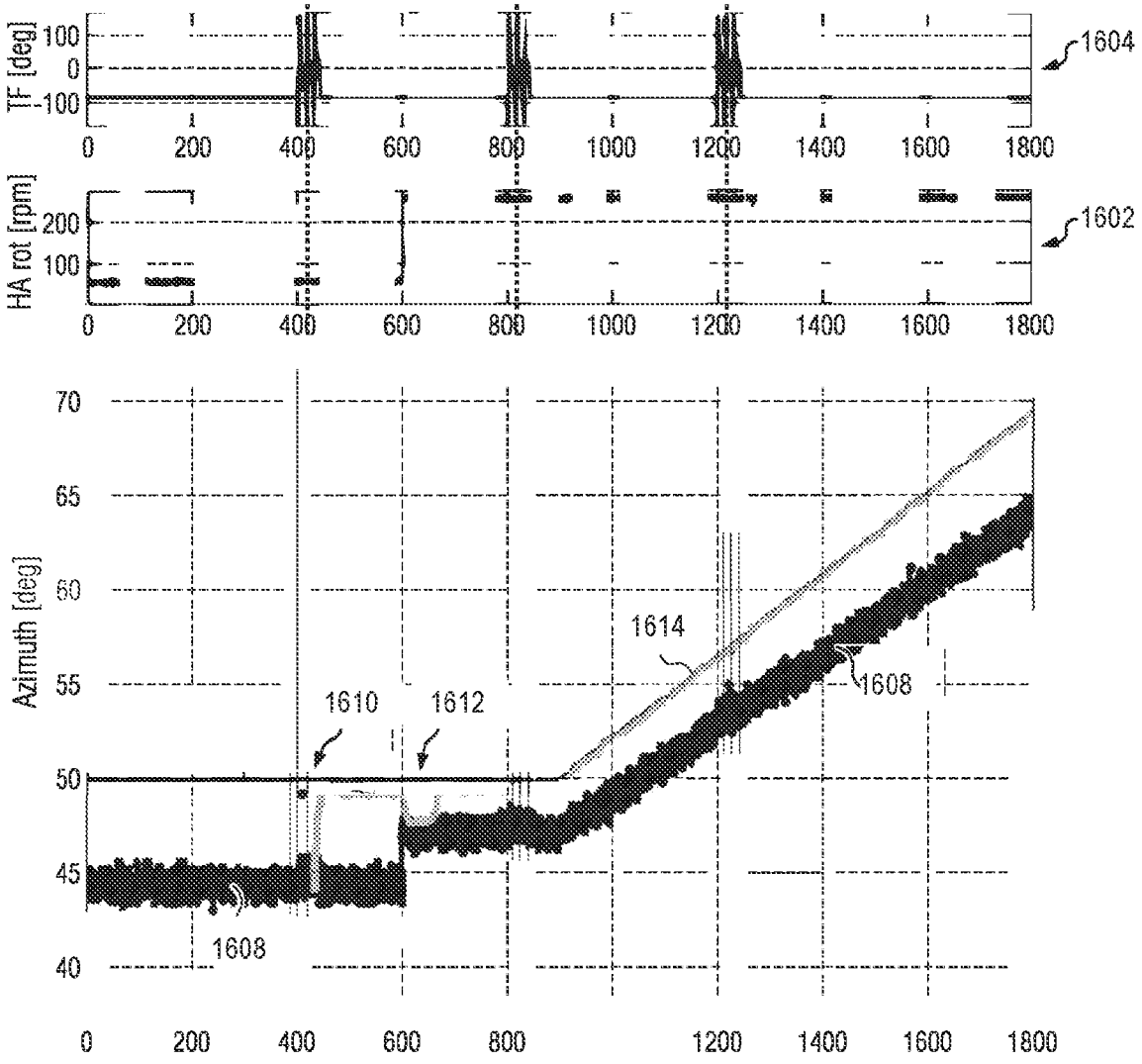
FIG. 16 depicts plots of sensor housing toolface, drill collar rotation rate, and wellbore azimuth with time for a synthetic example implementation of the methods depicted in FIG. 15.

The effectiveness of methods in FIGS. 15A and 15B is now shown in more detail by way of the following non-limiting synthetic example. FIG. 16 depicts plots of sensor housing toolface, drill collar rotation rate, and wellbore azimuth with time. In this example, the drill collar rotation rate 1602 increased from about 60 rpm to about 840 rpm at 600 seconds. The sensor housing slowly rotated through 4 full rotations at 4 rpm at 400, 800, and 1200 seconds and was otherwise geostationary at a toolface angle of −90 degrees as indicated at 1604. The true wellbore azimuth 1606 was constant at 50 degrees from 0 to 900 seconds and then increased linearly with time to 70 degrees at 1800 seconds. The wellbore azimuth computed using the original magnetometer measurements was from about 3 to about 6 degrees less than the true wellbore azimuth as indicated at 1608. At about 400 seconds (at 1610) the magnetometer bias was corrected using the methodology described above with respect to FIG. 15, however, the eddy current compensation was arbitrarily set to a default value based on the size (e.g., diameter) of the collar. The resulting wellbore azimuth measurements were about 1 degree less than the true wellbore azimuth (owing to the uncompensated eddy currents). At about 600 seconds, the rotation rate of the drill collar increased to about 840 rpm further increasing the eddy current error as shown at 1612. At about 1250 seconds the eddy current compensation term was updated but the magnetometer bias remained the same as the correction made at 400 seconds. Note that the azimuth error was significantly decreased but still significant. At about 800 and 1200 seconds the eddy current compensation terms and the magnetometer bias were updated simultaneously as described above with respect to FIG. 15. The resulting wellbore azimuth estimates were within about 0.1 degree or less of the true wellbore azimuth as shown at 1614.

With further reference to the methods disclosed in FIGS. 12, 13, and 15, it will be appreciated that the computed survey parameters (e.g., the wellbore inclination and wellbore azimuth) may be stored in downhole memory and/or transmitted to the surface, for example, via mud pulse telemetry, electromagnetic telemetry, wired drill pipe, or other telemetry techniques. In some embodiments, the accuracy of the wellbore inclination and wellbore azimuth may be sufficient such that the drilling operation may forego the use of conventional static surveying techniques. In such embodiments, the wellbore survey may be constructed at the surface based upon the transmitted measurements and/or downhole using a downhole processor.

With still further reference to FIGS. 12, 13, and 15, the computed survey parameters may be used to control and/or change the direction of drilling. For example, in many drilling operations the wellbore (or a portion of the wellbore) is drilled along a drill plan, such as a predetermined direction (e.g., as defined by the wellbore inclination and the wellbore azimuth) or a predetermined curvature. In some embodiments, the computed wellbore inclination and wellbore azimuth may be compared with a desired inclination and azimuth. The drilling direction may be changed, for example, in order to meet the drill plan, or when the difference between the computed and desired direction (inclination and azimuth) or curvature exceeds a predetermined threshold. Such a change in drilling direction may be implemented, for example, via actuating steering elements in a rotary steerable tool deployed above the bit (such as one of the rotary steerable tools described above). In some embodiments, the survey parameters may be computed in roll-stabilized housing in the RSS, which may further evaluate the survey parameters and the drill plan to compute a new drilling direction in order to meet the plan. In some embodiments the survey parameters may be sent to the surface using telemetry so that the survey parameters may be analysed. In view of the survey parameters, drilling parameters (e.g., weight on bit, rotation rate, mud pump rate, etc.) may be modified and/or a downlink may be sent to the RSS to change the drilling direction. In some embodiments both downhole and surface control may be used.

It will be appreciated that the methods described herein may be configured for implementation via one or more controllers deployed downhole (e.g., in a rotary steerable tool or in an MWD tool). A suitable controller may include, for example, a programmable processor, such as a digital signal processor or other microprocessor or microcontroller and processor-readable or computer-readable program code embodying logic. A suitable processor may be utilized, for example, to execute the method embodiments (or various steps in the method embodiments) described above with respect to FIGS. 12, 13, and 15. A suitable controller may also optionally include other controllable components, such as sensors (e.g., a temperature sensor), data storage devices, power supplies, timers, and the like. The controller may also be disposed to be in electronic communication with the accelerometers and magnetometers. A suitable controller may also optionally communicate with other instruments in the drill string, such as, for example, telemetry systems that communicate with the surface. A suitable controller may further optionally include volatile or non-volatile memory or a data storage device.

The embodiments of downhole survey system have been primarily described with reference to wellbore drilling operations; the downhole survey systems described herein may be used in applications other than the drilling of a wellbore. In other embodiments, downhole survey systems according to the present disclosure may be used outside a wellbore or other downhole environment used for the exploration or production of natural resources. For instance, downhole survey systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for drilling a subterranean wellbore, the method comprising:

rotating a bottom hole assembly (BHA) in the subterranean wellbore to drill, the BHA including a roll-stabilized housing deployed in a drill collar and configured to rotate with respect to the drill collar, a triaxial accelerometer set, a triaxial magnetometer set, and a gyroscopic azimuth sensor deployed in the roll-stabilized housing;

collecting azimuth measurements using the gyroscopic azimuth sensor;

using the triaxial accelerometer set and the triaxial magnetometer set to make corresponding triaxial accelerometer measurements and triaxial magnetometer measurements while the BHA rotates;

measuring a rotation rate of the drill collar while the BHA rotates;

generating a toolface of the BHA using the azimuth measurements;

generating an azimuth of the BHA using the toolface of the BHA, the triaxial magnetometer measurements, and the rotation rate; and determining an inclination of the BHA using the triaxial accelerometer measurements, wherein determining the inclination includes:

detecting a change in the rotation rate of the drill collar;

generating an eddy current compensation term using the change in the rotation rate of the drill collar and the triaxial magnetometer measurements, wherein the eddy current compensation term is generated from a change in an angle when the change in the rotation rate of the drill collar is detected, and wherein the angle is formed between gravity and magnetic field vectors in a cross axial plane of the drill collar; and inputting the inclination, the toolface, the triaxial magnetometer measurements, the eddy current compensation term, and a magnetometer bias into a Kalman filter to generate the azimuth and an updated magnetometer bias.

2. The method of claim 1, wherein the BHA further comprises a rotary steerable drilling tool, the roll-stabilized housing deployed in the rotary steerable drilling tool, and further comprising actuating a steering element on the rotary steerable drilling tool to change a direction of drilling.

3. The method of claim 1, wherein the eddy current compensation term is equal to a derivative of the angle with respect to the rotation rate of the drill collar.

4. The method of claim 1, further comprising:

generating an eddy current influence and the magnetometer bias, and wherein generating the azimuth includes compensating for the eddy current influence and the magnetometer bias.

5. A rotary steerable system for drilling a subterranean wellbore, the rotary steerable system comprising:

a roll-stabilized housing deployed in a drill collar, the drill collar configured to rotate with a drill string, the roll-stabilized housing configured to rotate independent of the drill collar while drilling;

an azimuth sensor package; and a controller, the controller including memory and a processor, the memory including instructions that cause the processor to:

collect gyroscopic azimuth measurements, accelerometer measurements, and magnetometer measurements using the azimuth sensor package;

measure a rotation rate of the roll-stabilized housing while the drill collar rotates;

generate a toolface of the drill collar using the gyroscopic azimuth measurements; and generate an azimuth of the drill collar using the toolface, the magnetometer measurements, and the rotation rate; and determine an inclination of the drill collar using the accelerometer measurements, wherein determining the inclination includes:

detecting a change in a rotation rate of the drill collar;

generating an eddy current compensation term using the change in the rotation rate of the drill collar and the magnetometer measurements, wherein the eddy current compensation term is generated from a change in an angle when the change in the rotation rate of the drill collar is detected, and wherein the angle is formed between gravity and magnetic field vectors in a cross axial plane of the drill collar; and inputting the inclination, the toolface, the magnetometer measurements, the eddy current compensation term, and a magnetometer bias into a Kalman filter to generate the azimuth and an updated magnetometer bias.

6. The rotary steerable system of claim 5, further comprising a rotary steerable drilling tool, the roll-stabilized housing deployed in the rotary steerable drilling tool, and wherein the instructions further cause the processor to actuate a steering element on the rotary steerable drilling tool to change a direction of drilling.

7. The rotary steerable system of claim 5, wherein the instructions further cause the processor to generate an eddy current influence and the magnetometer bias, and wherein generating the azimuth includes compensating for the eddy current influence and the magnetometer bias.

8. The rotary steerable system of claim 5, wherein the eddy current compensation term is equal to a derivative of the angle with respect to the rotation rate of the drill collar.

* * * * *